US006408268B1

(12) United States Patent
Tasaki

(10) Patent No.: US 6,408,268 B1
(45) Date of Patent: Jun. 18, 2002

(54) VOICE ENCODER, VOICE DECODER, VOICE ENCODER/DECODER, VOICE ENCODING METHOD, VOICE DECODING METHOD AND VOICE ENCODING/DECODING METHOD

(75) Inventor: Hirohisa Tasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/380,847

(22) PCT Filed: Sep. 24, 1997

(86) PCT No.: PCT/JP97/03366

§ 371 (c)(1),
(2), (4) Date: Dec. 22, 1999

(87) PCT Pub. No.: WO98/40877

PCT Pub. Date: Sep. 17, 1998

(30) Foreign Application Priority Data

Mar. 12, 1997 (JP) ..... 9-057214

(51) Int. Cl.[7] ..... G10L 19/08; G10L 19/10
(52) U.S. Cl. ..... 704/220; 704/223
(58) Field of Search ..... 704/219, 220, 704/221, 222, 223, 225, 206, 212

(56) References Cited

U.S. PATENT DOCUMENTS 4,776,015 A * 10/1988 Takeda et al. ..... 704/220
5,457,783 A * 10/1995 Chhatwal ..... 704/219
5,724,480 A * 3/1998 Yamaura ..... 704/219

FOREIGN PATENT DOCUMENTS

JP 03-119398 A 5/1991
JP 04-57100 A 2/1992
JP 05-273999 A 10/1993
JP 08-179796 A 7/1996

OTHER PUBLICATIONS

Honda, "Speech Coding using Waveform Matching based on LPC Residual Phase Equalization," 1990 International Conference on Acoustics, Speech, and Signal Processing, Apr. 3–6, 1990, vol. 1, pp. 213–216.*

The Transactions of the Institute of Electronics, Information and Communication Engineers vol. J79–A, Oct. 1996, pp. 1656–1660 "MP–CELP Speech Coding Based on Multi–Pulse Vector Quantization and Fast Search".

Eurospeech 91, 2nd European Conference on Speech Communication and Technology vol. 2, Sep. 1991, pp. 829–832, "A Very High–Quality CELP Coder at the rate of 2400 bps".

NTT R&D, Apr. issue, 1996 (No. 4, vol. 45, 1996), p. 325–330 Basic Algorithm of Conjugate—Structure Algebraic CELP (CS–ACELP) Speech Coder, Kataoka et al.

* cited by examiner

*Primary Examiner*—Marsha D. Banks-Harold
*Assistant Examiner*—Martin Lerner

(57) ABSTRACT

When input speech is separated into a spectrum-envelope information and an excitation signal, and the excitation signal is encoded at each frame based on a plurality of excitation signal positions and a plurality of excitation signal gains, the encoding characteristic is improved according to the present invention. In an excitation signal coding unit for encoding the excitation signal based on the plurality of excitation signal positions and the plurality of excitation signal gains, a phase adding filter gives a specific excitation signal phase characteristic to a calculated impulse response. An excitation signal coding unit encodes the excitation signal into a plurality of pulse excitation positions and a plurality of excitation signal gains.

3 Claims, 27 Drawing Sheets

MULTIPLEXING UNIT
CODING UNIT
LINEAR PREDICTIVE COEFFICIENT CODING UNIT
LINEAR PREDICTION ANALYZING UNIT
PLS. POS. SEAR. UNIT
TEM. GN. CAL. UT.
IMP. RES. CAL. UNIT
PUL. POS. CODEBOOK
GN. SEAR. UNIT
GAIN CODEBOOK
GN. CODG. UNIT
ADAPTIVE EXCI-TATION CODING UNIT
STOCHAS. EXCIT. CODING UNIT
1
3
5
6
8
9
10
11
12
18
19
20(118)
21
23
40
41
111
113
150
151
160
163
172a(133)
(131)
215
216

Fig.7

(a) FIRST PULSE POSITION CODEBOOK ($p > 48$)

| PULSE NO. | PULSE POSITION |
|---|---|
| 1 | 0, 5, 10, 15, 20, 25, 30, 35, 40, 45, 50, 55, 60, 65, 70, 75 |
| 2 | 1, 6, 11, 16, 21, 26, 31, 36, 41, 46, 51, 56, 61, 66, 71, 76 |
| 3 | 2, 7, 12, 17, 22, 27, 32, 37, 42, 47, 52, 57, 62, 67, 72, 77 |
| 4 | 3, 8, 13, 18, 23, 28, 33, 38, 43, 48, 53, 58, 63, 68, 73, 78, 4, 9, 14, 19, 24, 29, 34, 39, 44, 49, 54, 59, 64, 69, 74, 79 |

(b) SECOND PULSE POSITION CODEBOOK ($32 < p \leqq 48$)

| PULSE NO. | PULSE POSITION |
|---|---|
| 1 | 0, 3, 6, 9, 12, 15, 18, 21, 24, 27, 30, 33, 36, 39, 42, 45 |
| 2 | 1, 4, 7, 10, 13, 16, 19, 22, 25, 28, 31, 34, 37, 40, 43, 46 |
| 3 | 2, 5, 8, 11, 14, 17, 20, 23, 26, 29, 32, 35, 38, 41, 44, 47 |

(c) THIRD PULSE POSITION CODEBOOK ($p \leqq 32$)

| PULSE NO. | PULSE POSITION |
|---|---|
| 1 | 0, 4, 8, 12, 16, 20, 24, 28 |
| 2 | 1, 5, 9, 13, 17, 21, 25, 29 |
| 3 | 2, 6, 10, 14, 18, 22, 26, 30 |
| 4 | 3, 7, 11, 15, 19, 23, 27, 31 |

Fig.8

(a) PULSE POSITION CODEBOOK(P=32)

| PULSE NO. | PULSE POSITION |
|---|---|
| 1 | 0, 4, 8, 12, 16, 20, 24, 28 |
| 2 | 1, 5, 9, 13, 17, 21, 25, 29 |
| 3 | 2, 6, 10, 14, 18, 22, 26, 30 |
| 4 | 3, 7, 11, 15, 19, 23, 27, 31 |

300

CHANGE (b) PULSE POSITION CODEBOOK (P=20)

| PULSE NO. | PULSE POSITION |
|---|---|
| 1 | 0, 4, 8, 12, 16, 1, 5, 9 |
| 2 | 1, 5, 9, 13, 17, 2, 6, 10 |
| 3 | 2, 6, 10, 14, 18, 3, 7, 11 |
| 4 | 3, 7, 11, 15, 19, 0, 4, 8 |

310

311

Fig. 15
PRIOR ART

23

| PULSE No.(k) | PULSE POSITION m(k) |
|---|---|
| 1 | 0 1 2 3 4 5 6 7<br>0, 5, 10 , 15, 20, 25, 30, 35 |
| 2 | 0 1 2 3 4 5 6 7<br>1, 6, 11 , 16, 21, 26, 31, 36 |
| 3 | 0 1 2 3 4 5 6 7<br>2, 7, 12 , 17, 22, 27, 32, 37 |
| 4 | 0 1 2 3 4 5 6 7<br>3, 8, 13 , 18, 23, 28, 33, 38<br>8 9 10 11 12 13 14 15<br>4, 9, 14 , 19, 24, 29, 34, 39 |

230

| PULSE POSITION CODE (13BITS) | | | |
|---|---|---|---|
| RANGE | NUMBER OF BITS | CODE OF CIRCLED NUMBER | PULSE POSITION OF THE CIRCLED |
| 0~7 | 3 | 5 | m(1)=25 |
| 0~7 | 3 | 3 | m(2)=16 |
| 0~7 | 3 | 0 | m(3)=2 |
| 0~15 | 4 | 14 | m(4)=34 |

VOICE ENCODER, VOICE DECODER, VOICE ENCODER/DECODER, VOICE ENCODING METHOD, VOICE DECODING METHOD AND VOICE ENCODING/DECODING METHOD

This application is the national phase under 35 U.S.C. § of prior PCT International Application No. PCT/JP97/03366 which has an International filing date of Sep. 24, 1997 which designated the United States of America.

TECHNICAL FIELD

This invention relates to a method and apparatus for speech encoding, which performs compression-encoding for a speech signal to be a digital signal, and speech decoding, which performs expansion-decoding for the digital signal to be the speech signal. In addition, this invention relates to a method and apparatus for speech coding/decoding in which the speech encoding and the speech decoding are combined.

BACKGROUND ART

In many conventional speech coding/decoding apparatuses, an input speech is divided into spectrum-envelope information and an excitation signal. Then, the excitation signal is encoded per frame, and the encoded excitation signal is decoded to generate an output speech.

The spectrum-envelope information represents a general figure of an amplitude (power) spectrum of speech signal. The excitation signal is an energy source for generating speech. In a speech coding process and a speech synthesis, the excitation signal is represented by a form using a periodic pattern or a periodic series of pulses to be approximately shown. Many improvements have been performed especially for the method of excitation signal coding/decoding in order to enhance the quality of coding/decoding. A speech coding/decoding apparatus applying "celp" (code-excited linear predictive coding) is known as the most typical speech coding/decoding apparatus.

FIG. 13 shows a whole configuration of the conventional speech coding/decoding apparatus applying celp. In FIG. 13, a coding unit 1, decoding unit 2, multiplexing unit 3, separating unit 4, input speech 5, code 6 and an output speech 7 are shown. The coding unit 1 is composed of a linear prediction analyzing unit 8, linear predictive coefficient coding unit 9, adaptive excitation coding unit 10, stochastic excitation coding unit 11 and a gain coding unit 12. The decoding unit 2 is composed of a linear predictive coefficient decoding unit 13, synthesis filter 14, adaptive excitation decoding unit 15, stochastic excitation decoding unit 16 and a gain decoding unit 17.

A speech of around 5 to 50 ms long is defined as a frame in the conventional speech coding/decoding apparatus. The speech in the frame is divided into spectrum-envelope information and an excitation signal in order to be encoded.

The operation of the conventional speech coding/decoding apparatus will now be described. First, in the coding unit 1, the linear prediction analyzing unit 8 analyzes the input speech 5, and extracts a linear predictive coefficient which is the spectrum-envelope information of the speech. The linear predictive coefficient coding unit 9 encodes the linear predictive coefficient, and outputs the encoded code to the multiplexing unit 3 as a coded linear predictive coefficient 18 for excitation signal encoding.

Referring to FIGS. 20, 21 and 22, the excitation signal encoding is now explained. As shown in FIG. 20, a plurality of old excitation signals (that is, Sold excitation signals) is stored as adaptive excitations 113 corresponding to adaptive excitation codes 111 in an adaptive excitation codebook 110 of the adaptive excitation coding unit 10. A time series vector 114 is generated by periodically repeating the adaptive excitation 113, that is the old excitation signal, corresponding to each adaptive excitation code 111. Then, a temporary synthetic signal 116 is generated by multiplying each time series vector 114 by an appropriate gain "g" and filtering the multiplied time series vector 114 by using a synthesis filter 115 in which the coded linear predictive coefficient 18 is used. An error signal 118 is obtained based on a differential between the temporary synthetic signal 116 and the input speech 5 to calculate the distance between the temporary synthetic signal 116 and the input speech 5. This process is repeated S times by using each adaptive excitation 113. Then, the adaptive excitation code 111 which makes the distance shortest is selected. The time series vector 114 corresponding to the selected adaptive excitation code 111 is output as the adaptive excitation 113, and one of the error signals 118 corresponding to the selected adaptive excitation code 111 is also output.

As shown in FIG. 21, a plurality of stochastic excitations 133 (that is, T stochastic excitations) corresponding to stochastic excitation codes 131 is stored in a stochastic excitation codebook 130 of the stochastic excitation coding unit 11. A temporary synthetic signal 136 is generated by multiplying each stochastic excitation 133 by the appropriate gain "g" and filtering the multiplied stochastic excitation 133 by using a synthesis filter 135 in which the coded linear predictive coefficient 18 is used. The distance between the temporary synthetic signal 136 and the error signal 118 is calculated. This process is repeated T times by using each stochastic excitation 133. Then, the stochastic excitation code 131 which makes the distance shortest is selected and the stochastic excitation 133 corresponding to the selected stochastic excitation code 131 is also output.

As shown in FIG. 22, a plurality of gain groups (that is, U gain groups) corresponding to gain codes 151 is stored in a gain codebook 150 of the gain coding unit 12. A gain vector 154 (g1, g2) corresponding to each gain code 151 is generated. A temporary synthetic signal 156 is generated by multiplying the adaptive excitation 113 (time series vector 114) by the element g1 of each gain vector 154 with using a multiplier 166, multiplying the stochastic excitation 133 by the element g2 of each gain vector 154 with using a multiplier 167, adding the multiplied values with using an adder 968, and filtering the added value by using a synthesis filter in which the coded linear predictive coefficient 18 is used. The distance between the temporary synthetic signal 156 and the input speech 5 is calculated. This process is repeated U times by using each gain. Then, the gain code 151 which makes the distance shortest is selected. An excitation signal 163 is generated by multiplying the adaptive excitation 113 by the element g1 of the gain vector 154 corresponding to the selected gain code 151, multiplying the stochastic excitation 133 by the element g2 of the gain vector 154 corresponding to the selected gain code 151, and adding the multiplied values. The adaptive excitation coding unit 10 updates the adaptive excitation codebook 110 by using the excitation signal 163.

The multiplexing unit 3 multiplexes the coded linear predictive coefficient 18, adaptive excitation code 111, stochastic excitation code 131 and the gain code 151 and outputs the multiplexed value as the code 6. The separating unit 4 separates the code 6 into the coded linear predictive coefficient 18, adaptive excitation code 111, stochastic excitation code 131 and the gain code 151.

In the decoding unit 2, the linear predictive coefficient decoding unit 13 decodes a linear predictive coefficient out of the coded linear predictive coefficient 18 and sets the decoded coefficient as a coefficient of the synthesis filter 14. The adaptive excitation decoding unit 15 stores old excitation signals in an adaptive excitation codebook, and outputs a time series vector 128 made by periodically repeating plural old excitation signals corresponding to an adaptive excitation code. The stochastic excitation decoding unit 16 stores plural stochastic excitations in a stochastic excitation codebook, and outputs a time series vector 148 corresponding to a stochastic excitation code. The gain decoding unit 17 stores plural gain groups in a gain codebook and outputs a gain vector 168 corresponding to a gain code. In the decoding unit 2, an excitation signal 198 is generated by multiplying the time series vector 128 by the element g1 of the gain vector, multiplying the time series vector 148 by the element g2 of the gain vector, and adding the multiplied values. This excitation signal 198 is filtered by using the synthesis filter 14 to be the output speech 7. Then, the adaptive excitation codebook in the adaptive excitation decoding unit 15 is updated by using the generated excitation signal 198.

A speech coding/decoding apparatus applying celp wherein a pulse excitation is utilized for encoding a stochastic excitation in order to mainly reduce calculation amount and memory amount, is disclosed in an article by Akitoshi Kataoka, Shinji Hayashi, Takehiro Moriya, Syoko Kurihara and Kazunori Mano entitled "Basic Algorithm of Conjugate-Structure Algebraic CELP (CS-ACELP) Speech Coder" in NTT R&D, Vol.45 (April 1996), pp.325–330. (This article is hereinafter called "article 1")

FIG. 14 shows the configuration of the stochastic excitation coding unit 11 used in the conventional speech coding/decoding apparatus disclosed in article 1. The whole configuration of the speech coding/decoding apparatus is the same as FIG. 13. In FIG. 14, the coded linear predictive coefficient 18, a stochastic excitation code 19 which corresponds to the stochastic excitation code 131, an encoding-target signal 20 which corresponds to the error signal 118, an impulse response calculating unit 21, a pulse position search unit 22 and a pulse position codebook 23 are shown. The encoding-target signal 20 corresponds to the error signal 118, as shown in FIG. 21, made by multiplying (the time series vector 114 of) the adaptive excitation 113 by an appropriate gain, filtering the multiplied vector by using the synthesis filter 115, and subtracting the filtered signal from the input speech 5.

FIG. 15 is the pulse position codebook 23, used in article 1, showing examples of the range and the number of bits of a pulse position code 230.

In article 1, the length of the excitation signal encoding frame is composed of 40 samples, and the stochastic excitation is composed of four pulses. As shown in FIG. 15, the pulse positions of the number 1 pulse through number 3 pulse are restricted to eight positions. Because there are eight pulse positions, 0 through 7, each of the pulse positions can be encoded by 3 bits. The pulse positions of the number 4 pulse are restricted to sixteen pulse positions. Because there are sixteen pulse positions, 0 through 15, each of the pulse positions can be encoded by 4 bits. The pulse position codes indicating the four pulse positions become a codeword of 13 bits=3+3+3+4. By virtue of restricting the pulse positions, calculation amount is decreased with suppressing the coding characteristic deterioration, because the number of bits for encoding and the number of combinations are lessened.

Referring to FIGS. 23, 24 and 25, the operation of the stochastic excitation coding unit 11 in the above conventional speech coding/decoding apparatus will now be described.

The impulse response calculating unit 21 generates an impulse signal 210 as shown in FIG. 25, in an impulse signal generating unit 218. An impulse response 214 for the impulse signal 210 is calculated by using a synthesis filter 211 whose filter coefficient is the coded linear predictive coefficient 18.

A perceptual weighting unit 212 performs a perceptual weighting process for the impulse response 214, and outputs a perceptually weighted impulse response 215. The pulse position search unit 22 reads a pulse position (ex. [25, 16, 2, 34] in FIG. 15) stored in the pulse position codebook 23 one by one. The pulse position corresponds to a pulse position code 230 shown in FIG.15 (ex [5,3, 0, 14] in FIG. 23). A temporary pulse excitation 172 is generated by setting pulses having a fixed amplitude and an appropriate sign based on sign information 231 (ex.[0,0,1,1]:1 indicates positive, 0 indicates negative) at the read pulse positions ([25,16,2,34]) of a specific number (four). A temporary synthetic signal 174 is generated by convolutionally calculating the temporary pulse excitation 172 and the impulse response 215. Then the distance between the temporary synthetic signal 174 and the encoding-target signal 20 is calculated. This calculation is performed 8192 times (8×8×8×16) for all the combinations of the pulse positions. One of the pulse position codes 230 (ex. [5,3,0,14]) which makes the distance shortest is combined with the sign information 231 (ex. [0,0,1,1]) for each pulse. Then, the combined value is output as the stochastic excitation code 19 which corresponds to the stochastic excitation code 131 in FIG. 13. The temporary pulse excitation 172 (which corresponds to the stochastic excitation 133 in FIG. 13) corresponding to the selected pulse position code 230 is output to the gain coding unit 12 in the coding unit 1.

In article 1, the temporary pulse excitation 172 and the temporary synthetic signal 174 are not actually generated, but a correlation function between an impulse response and the encoding-target signal 20, and a mutual correlation function between impulse responses are calculated in advance for the purpose of reducing the calculation amount at the pulse position search unit 22. Calculation for obtaining the distance is performed by simply adding these calculated results of the correlation functions.

The distance calculation method will now be explained. To get the shortest distance is equivalent to get the largest D in the following expression (1). The shortest distance is searched by performing the calculation of D for all the combinations of pulse positions.

$$D = \frac{C^2}{E} \tag{1}$$

$$C = \sum_k g(k)d(m(k)) \tag{2}$$

$$E = \sum_k \sum_i g(k)g(i)\phi(m(k), m(i)) \tag{3}$$

m(k): pulse position of kth pulse g(k): pulse amplitude of kth pulse d(x): correlation between impulse response and input speech when an impulse is set at pulse position x $\phi$(x,y): correlation between an impulse response when an impulse is set at pulse position x and an impulse response when an impulse is set at pulse position y In the pulse position search unit 22 of article 1, the expressions (2) and (3) are simplified by defining that g(k) has the same sign (positive or negative) as d(m(k)) and the absolute value of g(k) is 1. Then, the simplified expressions (2) and (3) become as follows:

$$C = \sum_k d'(m(k)) \tag{4}$$

$$E = \sum_k \sum_i \phi'(m(k), m(i)) \tag{5}$$

$$d'(m(k)) = |d(m(k))| \tag{6}$$

$$\phi'(m(k),m(i)) = \mathrm{sign}[g(k)]\mathrm{sign}[g(i)]\phi(m(k),m(i)) \tag{7}$$

If d' and φ' are calculated in advance of beginning the calculation of D for all the pulse position combinations, D is obtained by only performing a small amount of calculation, that is simply adding by the expressions (4) and (5).

FIG. 16 is an illustration explaining the temporary pulse excitation 172 generated in the pulse position search unit 22. A sign of a pulse is defined depending on whether the correlation d(x) shown in (a) of FIG. 16 is positive or negative. The amplitude of the pulse is fixed to be 1. In the case that d(m(k)) is positive, a pulse hose amplitude is (+1) is set at the pulse position m(k). In the case that d(m(k)) is negative, a pulse whose amplitude is (−1) is set at the pulse position m(k). (b) of FIG. 16 shows the temporary pulse excitation 172 corresponding to the d(x) in (a) of FIG. 16.

The pulse excitation wherein high speed search can be performed by restricting the pulse positions is called "Excitation Signal applying Algebraic Code". This pulse excitation is hereinafter called "algebraic excitation". A speech coding/decoding apparatus applying the algebraic code for improving the speech coding characteristic is disclosed in an article by Kazunori Ozawa, Shinichi Taumi, and Toshiyuki Nomura entitled "MP-CELP Speech Coding based on Multi-Pulse Vector Quantization and Fast Search" represented in theses by the Institute of Electronics, Information and Communication Engineers, Vol.J79-A, No.10 (October 1996), pp.1655–1663. (This article is hereinafter called "article 2")

FIG. 17 shows the whole configuration of this conventional speech coding/decoding apparatus. In FIG. 17, a mode identifying unit 24, first pulse excitation coding unit 25, first gain coding unit 26, second pulse excitation coding unit 27, second gain coding unit 28, first pulse excitation decoding unit 29, first gain decoding unit 30, second pulse excitation decoding unit 31 and a second gain decoding unit 32 are shown. Reference numbers in FIG. 17 labeled correspondingly to FIG. 13 are omitted.

Comparing with FIG. 13, operations of newly added configurations in the speech coding/decoding apparatus will be described below.

The mode identifying unit 24 identifies a mode for excitation signal encoding based on an average pitch predictive gain, that is the rate of periodicity, and outputs the identification result as mode information. When the pitch periodicity is high, excitation signal coding is performed by using the first excitation signal coding mode meaning the adaptive excitation coding unit 10, the first pulse excitation coding unit 25 and the first gain coding unit 26. When the pitch periodicity is low, excitation signal coding is performed by using the second excitation signal coding mode meaning the second pulse excitation coding unit 27 and the second gain coding unit 28.

The first pulse excitation coding unit 25 generates a temporary pulse excitation corresponding to each pulse excitation code. Then, the temporary pulse excitation and an adaptive excitation output from the adaptive excitation coding unit 10 are multiplied by an appropriate gain. The multiplied signals are filtered by using a synthesis filter, in which a linear predictive coefficient output from the linear predictive coefficient coding unit 9 is used, in order to generate a temporary synthetic signal. A distance between the temporary synthetic signal and the input speech 5 is calculated, and pulse excitation code candidates are searched in the order of distance from the shortest to the farthest. A temporary pulse excitation corresponding to each pulse excitation code candidate is output.

The first gain coding unit 26 generates a gain vector corresponding to each gain code. Then, the adaptive excitation and the temporary pulse excitation are multiplied by each element of each gain vector, and the multiplied signals are added. The added signal is filtered by using a synthesis filter, in which a linear predictive coefficient output from the linear predictive coefficient coding unit 9 is used, in order to generate a temporary synthetic signal. A distance between the temporary synthetic signal and the input speech 5 is calculated. The temporary pulse excitation code and the gain code, which make the distance shortest, are selected. The selected gain code and a pulse excitation code corresponding to the selected temporary pulse excitation are output.

The second pulse excitation coding unit 27 generates a temporary pulse excitation corresponding to each pulse excitation code. Then, the temporary pulse excitation is multiplied by an appropriate gain. The multiplied temporary pulse excitation is filtered by using the synthesis filter, in which a linear predictive coefficient output from the linear predictive coefficient coding unit 9 is used, in order to generate a temporary synthetic signal. A distance between the temporary synthetic signal and the input speech 5 is calculated. The pulse excitation code makes the distance shortest is selected. In addition, pulse excitation code candidates are searched in the order of distance from the shortest to the farthest. A temporary pulse excitation corresponding to each pulse excitation code candidate is output.

The second gain coding unit 28 generates a temporary gain value corresponding to each gain code. Then, the temporary pulse excitation is multiplied by each gain value. The multiplied signal is filtered by using the synthesis filter, in which a linear predictive coefficient output from the linear predictive coefficient coding unit 9 is used, in order to generate a temporary synthetic signal. A distance between the temporary synthetic signal and the input speech 5 is calculated. A temporary pulse excitation and a gain code which make the distance shortest are selected. The selected gain code and a pulse excitation code corresponding to the selected temporary pulse excitation are output.

The multiplexing unit 3, in the case of the first excitation signal coding mode being used, multiplexes a linear predictive coefficient code, mode information, an adaptive excitation code, a pulse excitation code and a gain code, and outputs the multiplexed value as the code 6. In the case of the second excitation signal coding mode being used, the multiplexing unit 3 multiplexes the linear predictive coefficient code, the mode information, the pulse excitation code and the gain code, and outputs the multiplexed value as the code 6.

The separating unit 4, when the mode information is in the first excitation signal coding mode, separates the code 6 into the linear predictive coefficient code, the mode information, the adaptive excitation code, the pulse excitation code and the gain code. When the mode information is in the second excitation signal coding mode, the separating unit 4 separates the code 6 into the linear predictive coefficient code, the mode information, the pulse excitation code and the gain code.

In the case that the mode information is in the first excitation signal coding mode, the first pulse excitation decoding unit 29 outputs a pulse excitation corresponding to the pulse excitation code, and the first gain decoding unit 30 outputs a gain vector corresponding to the gain code. An excitation signal is generated in the decoding unit 2 by multiplying an output from the adaptive excitation decoding unit 15 by an element of the gain vector, multiplying the pulse excitation by the other element of the gain vector, and adding the multiplied values. This excitation signal is filtered by using the synthesis filter 14 to be the output speech 7.

In the case that the mode information is in the second excitation signal coding mode, the second pulse excitation decoding unit 31 outputs a pulse excitation corresponding to the pulse excitation code, and the second gain decoding unit 32 outputs a gain value corresponding to the gain code. An excitation signal is generated in the decoding unit 2 by multiplying the pulse excitation by the gain value. This excitation signal is filtered by using the synthesis filter 14 to be the output speech 7.

FIG. 18 shows the configuration of the first pulse excitation coding unit 25 or the second pulse excitation coding unit 27 in the above speech coding/decoding apparatus. In FIG. 18, a coded linear predictive coefficient 33, a pulse excitation code candidate 34, an encoding-target signal 35, an impulse response calculating unit 36, a pulse position candidate search unit 37, a pulse amplitude candidate search unit 38 and a pulse amplitude codebook 39 are shown.

The encoding-target signal 35, in the first pulse excitation coding unit 25, indicates a signal obtained by multiplying an adaptive excitation by an appropriate gain and subtracting the multiplied signal from the input speech 5. The encoding-target signal 35, in the second pulse excitation coding unit 27, indicates the input speech 5 itself The pulse position codebook 23 is the same as shown in FIGS. 14 and 15.

The impulse response calculating unit 36 calculates an impulse response of a synthesis filter whose filter coefficient is the coded linear predictive coefficient 33, and performs a perceptual weighting process for the impulse response. When the adaptive excitation code obtained in the adaptive excitation coding unit 10, that is a pitch period length, is shorter than a (sub)frame length being a basic unit for excitation signal coding, the above impulse response is filtered through a pitch filter.

The pulse position candidate search unit 37 reads a pulse position stored in the pulse position codebook 23 one by one, and generates a temporary pulse excitation by setting a pulse which has a fixed amplitude and an appropriate sign, at the read pulse positions of specific number. A temporary synthetic signal is generated by convolutionally calculating the temporary pulse excitation and the impulse response. Then, a distance between the temporary synthetic signal and the encoding-target signal 35 is calculated. Some combinations of pulse position candidates are searched in the order of distance from the shortest to the farthest, and output. However, similar to article 1, the temporary excitation signal and the temporary synthetic signal are not actually generated, but a correlation function between an impulse response and the encoding-target signal 35, and a mutual correlation function between impulse responses are calculated in advance. The calculation for obtaining the distance is performed by simply adding these calculated results of the correlation functions. The pulse amplitude candidate search unit 38 reads a pulse amplitude vector in the pulse amplitude codebook 39 one by one, calculates D in the expression (1) by using each of the pulse position candidates and this pulse amplitude vector. Then, some combinations of pulse position candidate and pulse amplitude candidate are selected in order of the value of D, from large to small, and output as the pulse excitation candidates 34.

FIG. 19 is an illustration explaining a temporary pulse excitation generated in the pulse position candidate search unit 37, and a temporary pulse excitation to which a pulse amplitude is added in the pulse amplitude candidate search unit 38. (a) and (b) of FIG. 19 are the same as (a) and (b) of FIG. 16. (c) of FIG. 19 shows a result of an amplitude being added to the temporary excitation signal, by using a pulse amplitude vector, in the pulse amplitude candidate search unit 38.

A conventional speech coding/decoding apparatus, in which encoding information amount of algebraic excitation is effectively reduced, is disclosed in an article by Hiroyuki Ehara, Kouji Yoshida, and Toshio Yagi, entitled "A Study on Phase Adaptive Pulse-Search in CELP Coding" in Japan Acoustic Association Theses, Vol.1 (September 1996), pp.273–274. (This article is hereinafter called "article 3 ") In article 3, an algebraic excitation is made to form pitch periods, by using an adaptive excitation code indicating pitch period length. Then, the amount of information for pulse position is reduced by taking a rarely selected pulse position away, depending upon the fact that when a timewise lag (phase) of the algebraic excitation is adapted based on peak position information of a pitch waveform of an adaptive excitation, pulse positions of the algebraic excitation are not uniformly selected.

A conventional speech coding/decoding apparatus, in which the amount of necessary information for an excitation signal is reduced by making the excitation signal composed of plural pulses form pitch periods, is disclosed in an article by Kazunori Ozawa and Suguru Kouseki, entitled "4.8 kb/s Multi-pulse Excited Speech Coder" in Japan Acoustic Association Theses, Vol.1 (September 1985), pp.203–204. (This article is hereinafter called "article 4 ")

In article 4, a frame is divided into subframes per pitch period, an excitation signal of each subframe is represented by pulses of a specific number, and one subframe in the frame is selected. An excitation signal of the whole frame is generated to form as the pulse excitation of the selected subframe is pitch-periodically repeated. Then, one of the subframes, which generates the best synthetic signal as the whole frame, is chosen as a selected period, and the pulse information of the selected period is encoded. The number of pulses in one frame is fixed to be four so as to fix the information amount of excitation signal coding in each frame.

A conventional speech coding/decoding apparatus, where the quality of representing excitation is improved by giving characteristics of phase and excitation signal wave to the pulse excitation, is disclosed in an article by Shigeru Hosoi, Yoshio Sato, and Tadayoshi Makino, entitled "A Study on Source of Pulse Excitation Coding" represented in the theses A-254 by the Institute of Electronics, Information and Communication Engineers, (March 1992), (This article is hereinafter called "article 5 "), and in an article by Tadashi Yamaura, and Shinya Takahashi, entitled "Improving the Quality of CELP Coder at Low Bit Rates" represented in the theses by Japan Acoustic Association Vol.1 (October, November 1994), pp.263, 264. (This article is hereinafter called "article 6 ")

In article 5, a fixed excitation signal wave characteristic is added to a pulse excitation. This is described to be "pulse waveform" in article 5. An excitation signal of (sub)frame long is generated by repeating the excitation signal wave with a (pitch) period of longtime predictive delay. An excitation signal gain and an excitation signal wave head position, which make a distortion between a synthetic signal based on the generated excitation signal and an input speech minimum, are searched, and the searching result is encoded.

In article 6, a quantized phase amplitude characteristic is added to an adaptive excitation and a pulse excitation. A filter coefficient for adding the phase amplitude characteristic stored in a phase amplitude characteristic codebook is read one by one. Filtering for adding the phase amplitude characteristic and synthesizing is performed for the excitation signal of a frame long which is obtained by adding the pulse excitation and adaptive excitation repeated with lag (pitch) period of the adaptive excitation. Then, a phase amplitude characteristic code, an adaptive excitation code and a pulse excitation code for the phase amplitude characteristic filter coefficient and the excitation signal, which make the distance between the obtained synthetic signal and the input speech shortest, are output.

A conventional speech coding/decoding apparatus, in which coding quality performed between voiced sounds is improved by using a stochastic codebook partially containing an excitation signal made of a series of pulses, is disclosed in an article by Gao Yang, H. Leich, and R. Boite, entitled "A Very High-Quality Celp Coder at the Rate of 2400 bps" in EUROSPEECH '91, pp.829–832. (This article is hereinafter called "article 7")

In article 7, one excitation signal codebook is composed of a series of pulses repeated with a pitch period (lag length of adaptive excitation), a series of pulses repeated with a half pitch period, and a noise whose biggest part is made up to be zero (sparse).

The conventional speech coding/decoding apparatuses disclosed in the above articles 1 through 7 have the following problems.

In the speech coding/decoding apparatus of article 1, a temporary excitation signal is generated by setting a pulse which has a fixed amplitude and an appropriate sign, and the search of the pulse position is performed. Therefore, in the case of giving an independent gain (amplitude) to each pulse for the purpose of improving, an approximation to get the fixed amplitude enormously effects on the searching result. Consequently, there is a problem that the most appropriate pulse position can not be found.

In order to suppress the effect of the approximation, the method of keeping plural pulse position candidates is applied in article 2. The method is done by selecting the most appropriate pulse position based on a combination of each pulse position candidate with a pulse amplitude candidate. However, here is a problem that calculation amount is increased.

In the speech coding/decoding apparatus disclosed in article 2, determining which mode to be used between the first excitation signal coding mode that performs encoding by adding the adaptive excitation and the algebraic excitation, and the second excitation signal coding mode that performs encoding only using the algebraic excitation, depends upon the rate of pitch periodicity. However, there is a case that using the adaptive excitation is desirable even though the pitch periodicity is low, or using only the algebraic excitation for encoding is desirable even though the pitch periodicity is high. Namely, there exists the problem that mode identification for getting the best coding characteristic can not be performed.

As an example of the case that using the adaptive excitation is desirable even though the pitch periodicity is low, there is a case that it is difficult to satisfactorily represent an excitation signal when the pitch period is short and the number of pulses having the algebraic excitation is small. The less amount of excitation signal encoding information becomes or the less the number of pulses becomes, the more this tendency becomes. As an example of the case that using only the algebraic excitation for encoding is desirable even though the pitch periodicity is high, there is a case that it is possible to satisfactorily represent an excitation signal even when the pitch period is long and the number of pulses of the algebraic excitation is small. As known from these examples, it is necessary to adaptively change the threshold for determining the mode depending upon the pitch period and the number of pulses. However, in the speech coding/decoding apparatus of article 2, there is a problem that determining the mode for getting the best coding characteristic cannot be performed because it is not adaptively processed.

In the speech coding/decoding apparatus disclosed in article 3, the algebraic excitation is made to form pitch periods. However, it is necessary to certainly use both the adaptive excitation and the algebraic excitation because the pitch period is based on an adaptive excitation code. Consequently, there is a problem that the speech coding characteristic is deteriorated at the part where the adaptive excitation having bad coding characteristic is applied. For example, when excitation signal pitch periodicity of the present frame is high but an excitation signal of previous frame does not resemble the excitation signal of present frame, it is desirable that the algebraic excitation is made to form pitch periods though the efficiency of the adaptive excitation is bad.

Even when the coding is performed for the above part by using the second excitation signal coding mode, which encodes the excitation signal by using only the algebraic excitation, as shown in article 2, the problem of bad coding characteristic still exists because the algebraic excitation is not made to form pitch periods. The method of separately encoding the pitch period can be a way of making the algebraic excitation in article 2 form pitch periods. However, there is a problem that the quality is deteriorated because information amount needed for encoding the pitch period is large and the number of pulses is small.

In the speech coding/decoding apparatus disclosed in article 3, information amount for the pulse position is reduced by taking a rarely selected pulse position away. However, when the pitch period is short, there is useless information in the coding information because a pulse position which is never used exists.

In the speech coding/decoding apparatus disclosed in article 4, pulse information of a subframe whose pitch period length represents a frame is encoded, and the pulse excitation is made to form pitch periods. However, there is also useless information in the coding information, similar to the case of article 3, because a method of encoding pulse positions for a wide encoding range is always used even when the pitch period is short and encoding range for pulse positions is small.

In the speech coding/decoding apparatus disclosed in article 5, an excitation signal of (sub)frame long is generated by repeating a fixed excitation signal wave with a pitch period. An excitation signal gain and an excitation signal wave head position, which make the distortion of a synthetic signal based on the generated excitation signal and an input speech minimum, are searched. However, the calculation amount necessary for calculating the distance at each head position of the excitation signal wave is large. According to some conditions, it may be one hundred times as much as the calculation order amount in article 1. Therefore, it is necessary to keep the number of combinations of excitation signal positions small (equal to or less than one hundred) as disclosed in article 5, in order to process within a practical time. Namely, when the number of excitation signal combinations, by which an excitation signal position of each pitch period long can be separately determined, is large (equal to or more than ten thousand), there is a problem that it is impossible to process within the practical time.

In the speech coding/decoding apparatus disclosed in article 6, a quantized phase amplitude characteristic is added to the adaptive excitation and the pulse excitation. Similar to the case in article 5, however, distance calculation amount at an excitation signal position is large. Therefore, when the number of combinations of pulse positions becomes large, searching calculation amount proportionally increases. Consequently, there is a problem that it is impossible to process within the practical time.

In the speech coding/decoding apparatus disclosed in article 7, coding quality performed between voiced sounds is improved by using the stochastic codebook partially containing an excitation signal made of a series of pulses. However, it is only possible to represent a series of pulses repeated with a pitch period, a series of pulses with a half pitch period, and a sparse noise. As only specific excitation signals can be represented, there is a problem that coding characteristic is deteriorated depending upon the input speech. In addition, it is necessary for the number of codes to be the same as the number of excitation signal samples, that means the number of pulse head positions in the series of periodic pulse excitations. Namely, there is a problem that a part cannot be series of pulse excitations in a small-sized codebook.

In order to solve the above problems, this invention provides a speech coding apparatus, a speech decoding apparatus and a speech coding/decoding apparatus in which the coding characteristic, at the time of an input speech being divided into spectrum-envelope information and an excitation signal to perform encoding per frame, is greatly improved.

DISCLOSURE OF THE INVENTION

A speech coding apparatus according to the present invention, which separates an input speech into spectrum-envelope information and an excitation signal, and encodes the excitation signal at each frame, comprises an excitation signal coding unit (11, 12) for encoding the excitation signal based on a plurality of excitation signal positions and a plurality of excitation signal gains. The excitation signal coding unit (11, 12) includes a temporary gain calculating unit (40) for calculating a temporary gain for each of excitation signal position candidates, an excitation signal position search unit (41) for determining each of the plurality of excitation signal positions based on the temporary gain, and a gain coding unit (12) for encoding the plurality of excitation signal gains based on each of the plurality of excitation signal positions.

A speech coding/decoding apparatus according to the present invention has a coding unit (1) for separating an input speech into spectrum-envelope information and an excitation signal and encoding the excitation signal at each frame, and a decoding unit (2) for generating an output speech by decoding an encoded excitation signal. The coding unit (1) of the speech coding/decoding apparatus comprises an excitation signal coding unit (11, 12) for encoding the excitation signal based on a plurality of excitation signal positions and a plurality of excitation signal gains. The excitation signal coding unit (11, 12) includes a temporary gain calculating unit (40) for calculating a temporary gain for each of excitation signal position candidates, an excitation signal position search unit (41) for determining each of the plurality of excitation signal positions based on the temporary gain, and a gain coding unit (12) for encoding the plurality of excitation signal gains based on each determined excitation signal position.

The decoding unit (2) of the speech coding/decoding apparatus comprises an excitation signal decoding unit (16,17) for generating an excitation signal by decoding the plurality of excitation signal positions and the plurality of excitation signal gains.

A speech coding apparatus according to the present invention separates an input speech into spectrum-envelope information and an excitation signal, and encodes the excitation signal at each frame. The speech coding apparatus comprises an impulse response calculating unit (21) for calculating an impulse response of a synthesis filter, based on the spectrum-envelope information, a phase adding filter (42) for giving a specific excitation signal phase characteristic to the impulse response, and an excitation signal coding unit (22, 12) for encoding the excitation signal into a plurality of pulse excitation positions and a plurality of excitation signal gains, by using the impulse response to which the specific excitation signal phase characteristic has been added.

A speech coding/decoding apparatus according to the present invention has a coding unit (1) for separating an input speech into spectrum-envelope information and an excitation signal and encoding the excitation signal at each frame, and a decoding unit (2) for generating an output speech by decoding an encoded excitation signal. The coding unit (1) of the speech coding/decoding apparatus comprises an impulse response calculating unit (21) for calculating an impulse response of a synthesis filter, based on the spectrum-envelope information, a phase adding filter (42) for giving a specific excitation signal phase characteristic to the impulse response, and an excitation signal coding unit (22, 12) for encoding the excitation signal into a plurality of pulse excitation positions and a plurality of excitation signal gains, based on the impulse response to which the specific excitation signal phase characteristic has been added. The decoding unit (2) of the speech coding/decoding apparatus comprises an excitation signal decoding unit (16,17) for generating an excitation signal by decoding the plurality of pulse excitation positions and the plurality of excitation signal gains.

A speech coding apparatus according to the present invention separates an input speech into spectrum-envelope information and an excitation signal, and encodes the excitation signal at each frame. The speech coding apparatus comprises an excitation signal coding unit (11, 12) for encoding the excitation signal based on a plurality of pulse excitation positions and a plurality of excitation signal gains. The excitation signal coding unit (11, 12) includes a plurality of excitation signal position candidate tables (51, 52), one of which is selected to be used when the pitch period is equal to or less than a specific value.

A speech decoding apparatus according to the present invention which generates an output speech by decoding an excitation signal encoded at each frame, comprises an excitation signal decoding unit (16, 17) for generating an excitation signal by decoding a plurality of pulse excitation positions and a plurality of excitation signal gains. The excitation signal decoding unit (16, 17) includes a plurality of excitation signal position candidate tables (55, 56), one of which is selected to be used when the pitch period is equal to or less than a specific value.

A speech coding/decoding apparatus according to the present invention has a coding unit (1) for separating an input speech into spectrum-envelope information and an excitation signal and encoding the excitation signal at each frame, and a decoding unit (2) for generating an output speech by decoding an encoded excitation signal. The coding unit (1) of the speech coding/decoding apparatus comprises an excitation signal coding unit (11, 12) for encoding the excitation signal based on a plurality of pulse excitation positions and a plurality of excitation signal gains. The excitation signal coding unit (11, 12) includes a plurality of excitation signal position candidate tables (51, 52), one of which is selected to be used when the pitch period is equal to or less than a specific value.

The decoding unit (2) of the speech coding/decoding apparatus comprises an excitation signal decoding unit (16, 17) for generating an excitation signal by decoding a plurality of pulse excitation positions and a plurality of excitation signal gains. The excitation signal decoding unit (16, 17) includes a plurality of excitation signal position candidate tables (55, 56), one of which is selected to be used when the pitch period is equal to or less than a specific value.

A speech coding apparatus separates an input speech into spectrum-envelope information and an excitation signal, and encodes the excitation signal at each frame.

The speech coding apparatus comprises an excitation signal coding unit (11, 12) for encoding an excitation signal of a pitch period long based on a plurality of pulse excitation positions and a plurality of excitation signal gains. A code indicating a pulse excitation position (300) more than a pitch period is reset to indicate a pulse excitation position (310) within a range of the pitch period.

A speech decoding apparatus according to the present invention, which generates an output speech by decoding an excitation signal encoded at each frame, comprises an excitation signal decoding unit (16, 17) for generating an excitation signal of a pitch period long by decoding a plurality of pulse excitation positions and a plurality of excitation signal gains, wherein a code indicating a pulse excitation position (300) more than a pitch period is reset to indicate a pulse excitation position (310) within a range of the pitch period.

A speech coding/decoding apparatus according to the present invention has a coding unit (1) for separating an input speech into spectrum-envelope information and an excitation signal and encoding the excitation signal at each frame, and a decoding unit (2) for generating an output speech by decoding an encoded excitation signal.

The coding unit (1) of the speech coding/decoding apparatus comprises an excitation signal coding unit (11, 12) for encoding the excitation signal of a pitch period long based on a plurality of pulse excitation positions and a plurality of excitation signal gains, wherein a code indicating a pulse excitation position (300) more than a pitch period is reset to indicate a pulse excitation position (310) within a range of the pitch period.

The decoding unit (2) of the speech coding/decoding apparatus comprises an excitation signal decoding unit (16, 17) for generating an excitation signal of a pitch period long by decoding a plurality of pulse excitation positions and a plurality of excitation signal gains, wherein a code indicating a pulse excitation position (300) more than a pitch period is reset to indicate a pulse excitation position (310) within a range of the pitch period.

A speech coding apparatus according to the present invention separates an input speech into spectrum-envelope information and an excitation signal, and encodes the excitation signal at each frame. The speech coding apparatus comprises a first excitation signal coding unit (10, 11, 12) for encoding the excitation signal based on a plurality of pulse excitation positions and a plurality of excitation signal gains, a second excitation signal coding unit (57, 58) different from the first excitation signal coding unit, and a selecting unit (59) for comparing an encoding-distortion output from the first excitation signal coding unit with an encoding-distortion output from the second excitation signal coding unit, and selecting one of the first excitation signal coding unit and the second excitation signal coding unit which has a smaller encoding-distortion.

A speech coding/decoding apparatus according to the present invention has a coding unit (1) for separating an input speech into spectrum-envelope information and an excitation signal and encoding the excitation signal at each frame, and a decoding unit (2) for generating an output speech by decoding an encoded excitation signal. The coding unit (1) of the speech coding/decoding apparatus comprises a first excitation signal coding unit (10, 11, 12) for encoding the excitation signal based on a plurality of pulse excitation positions and a plurality of excitation signal gains, a second excitation signal coding unit (57, 58) different from the first excitation signal coding unit, and a selecting unit (59) for comparing an encoding-distortion output from the first excitation signal coding unit with an encoding-distortion output from the second excitation signal coding unit, and selecting one of the first excitation signal coding unit and the second excitation signal coding unit which has a smaller encoding-distortion. The decoding unit (2) of the speech coding/decoding apparatus comprises a first decoding unit (15, 16, 17) corresponding to the first excitation signal coding unit, a second decoding unit (60, 61) corresponding to the second excitation signal coding unit, and a controlling unit (330) for determining to use one of the first excitation signal decoding unit and the second excitation signal decoding unit based on a selection result led by the selecting unit.

A speech coding apparatus according to the present invention separates an input speech into spectrum-envelope information and an excitation signal, and encodes the excitation signal at each frame. The speech coding apparatus comprises a plurality of excitation signal codebooks (63, 64) composed of a plurality of codewords (340) indicating excitation signal position information and a plurality of codewords (350) indicating excitation signal waveforms, wherein every excitation signal position information represented by each of the plurality of codewords, in each of the plurality of excitation signal codebooks is different, and an excitation signal coding unit (11) for encoding the excitation signal by using the plurality of excitation signal codebooks.

In the speech coding apparatus according to the present invention, the number of the plurality of codewords (340) indicating excitation signal position information in the plurality of excitation signal codebooks (63, 64) is controlled depending upon a pitch period.

A speech decoding apparatus according to the present invention which generates an output speech by decoding an excitation signal encoded at each frame comprises a plurality of excitation signal codebooks (63, 64) composed of a plurality of codewords (340) indicating excitation signal position information and a plurality of codewords (350) indicating excitation signal waveforms, wherein every excitation signal position information represented by each of the plurality of codewords in each of the plurality of excitation signal codebooks is different, and an excitation signal decoding unit (16) for decoding the excitation signal by using the plurality of excitation signal codebooks.

A speech coding/decoding apparatus according to the present invention has a coding unit (1) for separating an input speech into spectrum-envelope information and an excitation signal and encoding the excitation signal at each frame, and a decoding unit (2) for generating an output speech by decoding an encoded excitation signal. The coding unit (1) of the speech coding/decoding apparatus comprises a plurality of excitation signal codebooks (63, 64) composed of a plurality of codewords (340) indicating excitation signal position information and a plurality of codewords (350) indicating excitation signal waveforms, wherein every excitation signal position information represented by each of the plurality of codewords in each of the plurality of excitation signal codebooks is different, and an excitation signal coding unit (11) for encoding the excitation signal by using the plurality of excitation signal codebooks. The decoding unit (2) of the speech coding/decoding apparatus comprises a plurality of excitation signal codebooks having coincident contents with the plurality of excitation signal codebooks (63, 64), and an excitation signal decoding unit (16) for decoding the excitation signal by using the plurality of excitation signal codebooks.

According to the present invention, a speech coding method, for separating an input speech into spectrum-envelope information and an excitation signal and encoding the excitation signal at each frame, comprises a step of encoding the excitation signal based on a plurality of excitation signal positions and a plurality of excitation signal gains. The encoding step includes steps of calculating a temporary gain for each of excitation signal position candidates, searching each of a plurality of excitation signal positions based on the temporary gain, and encoding the plurality of excitation signal gains based on each of plurality of searched excitation signal positions.

According to the present invention, a speech coding method, for separating an input speech into spectrum-envelope information and an excitation signal and encoding the excitation signal at each frame, comprises steps of calculating an impulse response of a synthesis filter based on the spectrum-envelope information, adding a specific excitation signal phase characteristic to the impulse response, and encoding the excitation signal into a plurality of pulse excitation positions and a plurality of excitation signal gains, by using the impulse response to which the specific excitation signal phase characteristic has been added.

According to the present invention, a speech coding method, for separating an input speech into spectrum-envelope information and an excitation signal and encoding the excitation signal at each frame, comprises a step of encoding the excitation signal based on a plurality of pulse excitation positions and a plurality of excitation signal gains. The encoding step including a step of switching one of excitation signal position candidate tables to be in use, when the pitch period is equal to or less than a specific value.

According to the present invention, a speech coding method, for separating an input speech into spectrum-envelope information and an excitation signal and encoding the excitation signal at each frame, comprises a step of encoding an excitation signal of a pitch period long, based on a plurality of pulse excitation positions and a plurality of excitation signal gains. The encoding step includes a step of resetting a code indicating a pulse excitation position more than a pitch period to indicate a pulse excitation position within a range of the pitch period.

According to the present invention, a speech coding method, for separating an input speech into spectrum-envelope information and an excitation signal, and encoding the excitation signal at each frame, comprises steps of encoding the excitation signal based on a plurality of pulse excitation positions and a plurality of excitation signal gains, encoding the excitation signal differently from the said encoding step, and selecting one of the encoding steps which has a smaller encoding-distortion by comparing encoding-distortions output in the encoding steps.

According to the present invention, a speech coding method, for separating an input speech into spectrum-envelope information and an excitation signal and encoding the excitation signal at each frame, comprises a step of encoding the excitation signal by using a plurality of excitation signal codebooks composed of a plurality of codewords indicating excitation signal position information and a plurality of codewords indicating excitation signal waveforms, wherein every excitation signal position information represented by each of the plurality of codewords in each of the plurality of excitation signal codebooks is different.

In the speech coding apparatus according to the present invention, temporary gain calculating unit (40) selects each of the excitation signal position candidates in order to calculate the temporary gain for each selected excitation signal position candidate on a supposition that one pulse is set for the selected excitation signal position candidate at each selecting in a frame.

In the speech coding apparatus according to the present invention, the gain coding unit (12) calculates an excitation signal gain, different from the temporary gain, for each of the plurality of excitation signal positions determined by the excitation signal position search unit (41), and encodes a calculated excitation signal gain.

BRIEF DESCRIPTION OF THE DRAWINGS

FIG. 7 shows some examples of the first pulse position codebook through the nth pulse position codebook used in the speech coding/decoding apparatus of FIGS. 5 and 6;

FIG. 8 shows some examples of a pulse position codebook used in a speech coding/decoding apparatus according to Embodiment 4 of the present invention;

FIG. 15 shows a configuration of a conventional pulse position codebook;

BEST MODE FOR CARRYING OUT THE INVENTION

With reference to the drawings, embodiments of the invention will be explained as follows:

Embodiment 1

Figure 1:
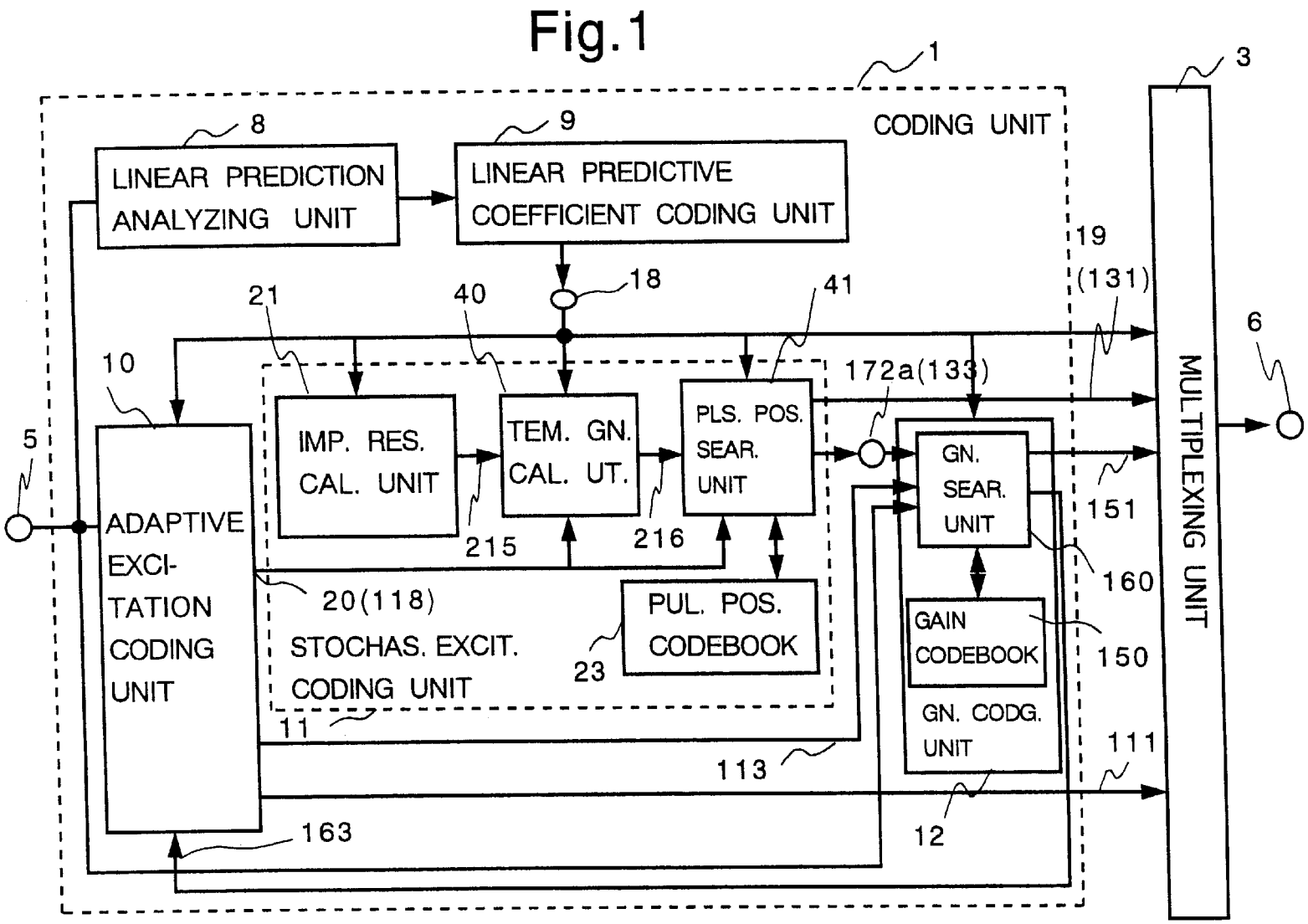
FIG. 1 is a block diagram showing a speech coding/decoding apparatus and a stochastic excitation coding unit in the speech coding/decoding apparatus, according to Embodiment 1 of the present invention.

FIG. 1 shows a configuration of a speech coding/decoding apparatus according to Embodiment 1 of the present invention. FIG. 1 shows the whole configuration of the speech coding/decoding apparatus and a stochastic excitation coding unit 11. The reference numbers in FIG. 1 are labeled correspondingly to those in FIGS. 13 and 14.

Figure 20:
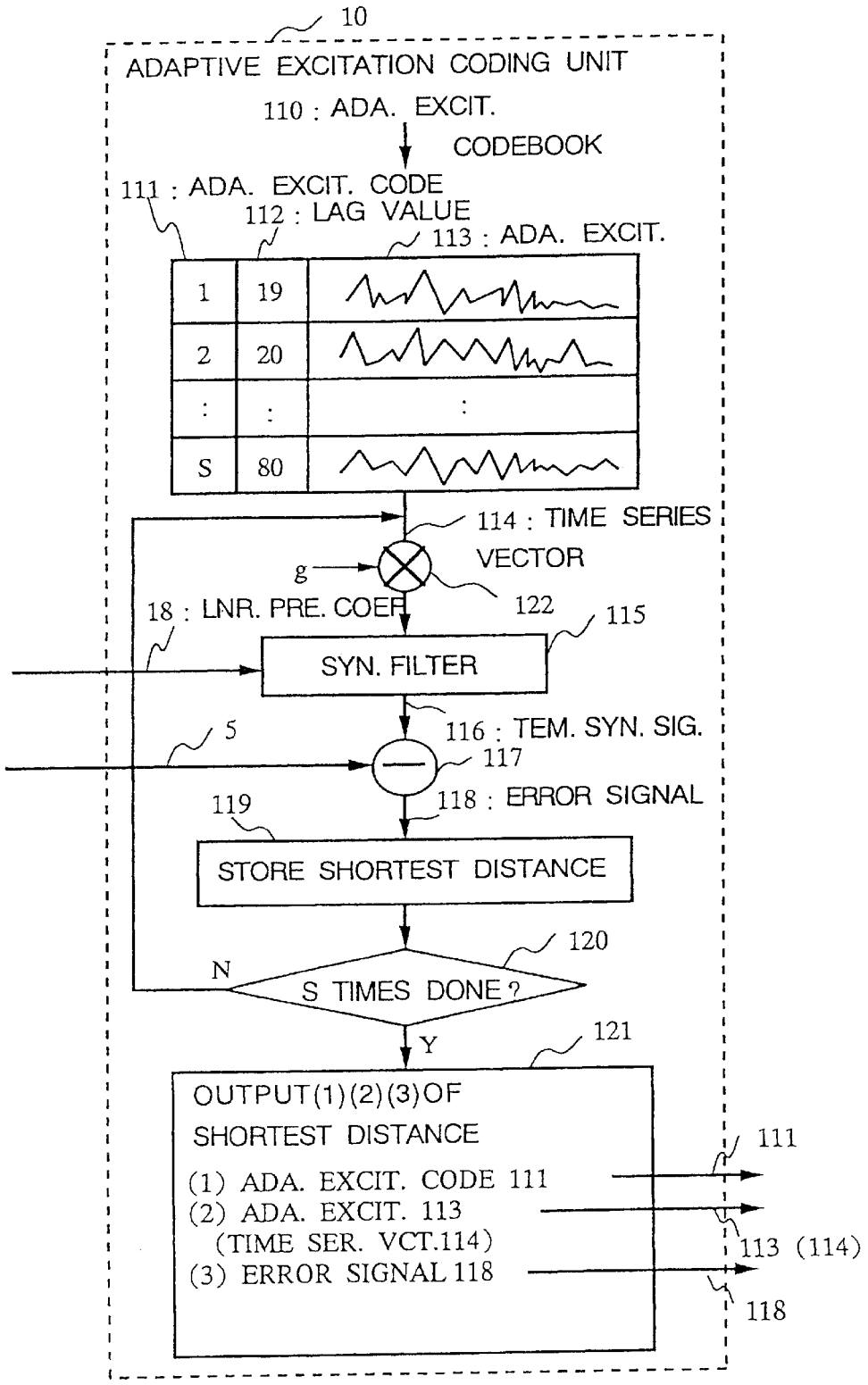
Fig.20 PRIOR ART
FIG. 20 shows the operation of a conventional adaptive excitation coding unit.
Figure 21:
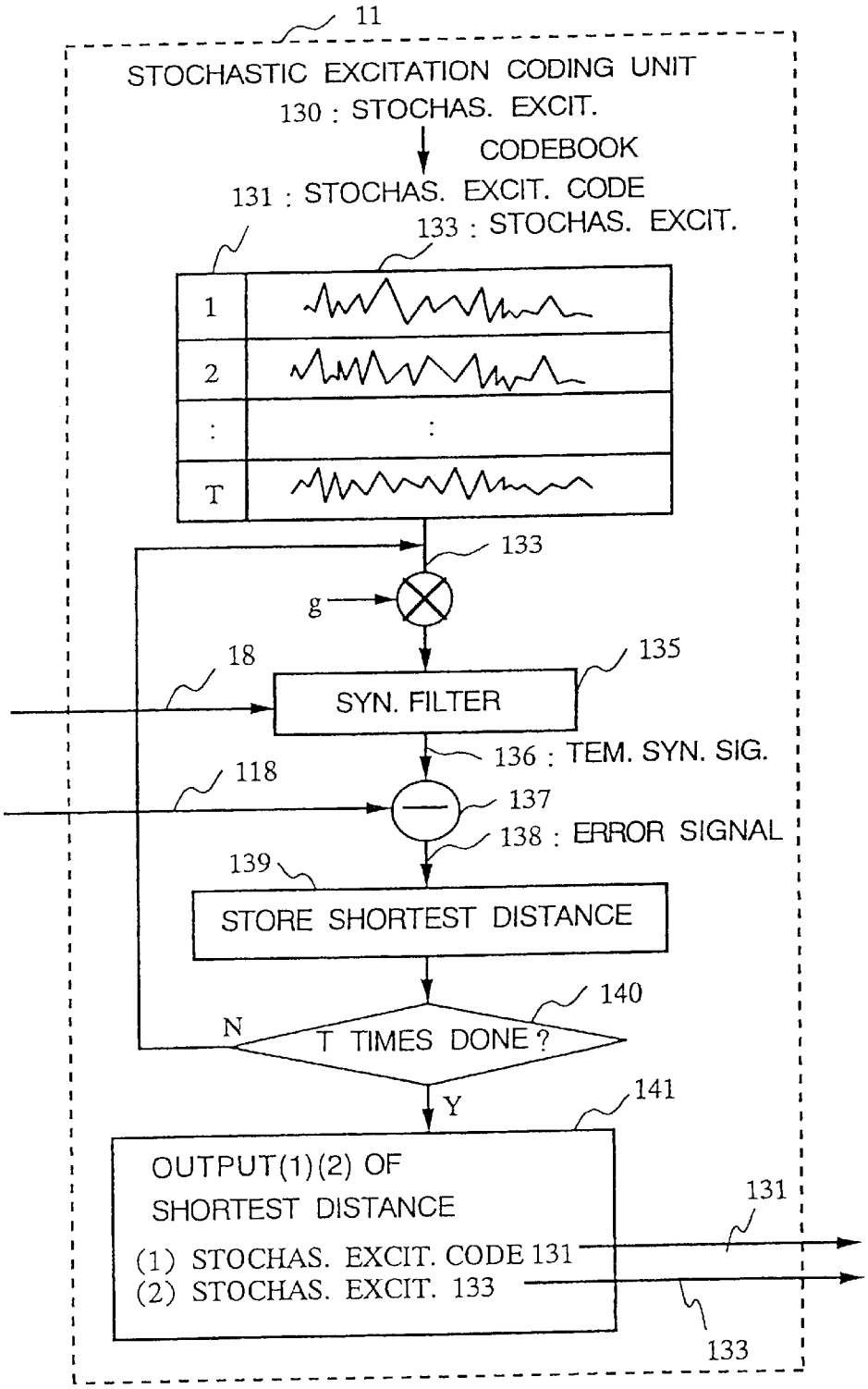
Fig.21 PRIOR ART
FIG. 21 shows the operation of a conventional stochastic excitation coding unit.

In FIG. 1, a temporary gain calculating unit 40 and a pulse position search unit 41, which are newly added units, are shown. The temporary gain calculating unit 40 calculates correlation between an impulse response 215 output from an impulse response calculating unit 21, and an encoding-target signal 20 indicating an error signal 118 shown in FIG. 20. A temporary gain is calculated based on the correlation. A temporary gain 216 indicates a gain value for a pulse which is set at a pulse position based on a pulse position codebook 23.

Figure 26:
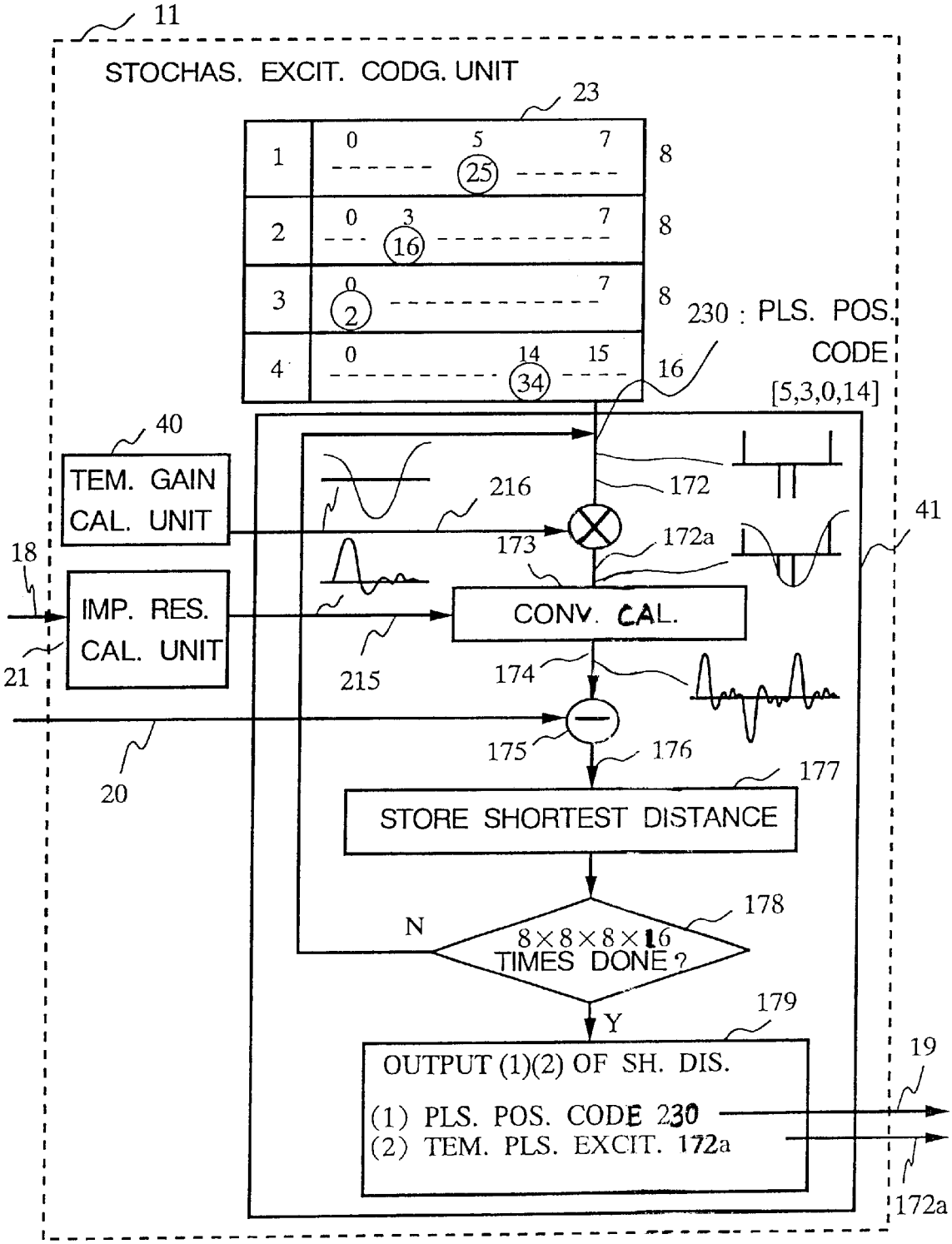
FIG. 26 shows the operation of a stochastic excitation coding unit according to Embodiment 1 of the present invention.
Figure 27:
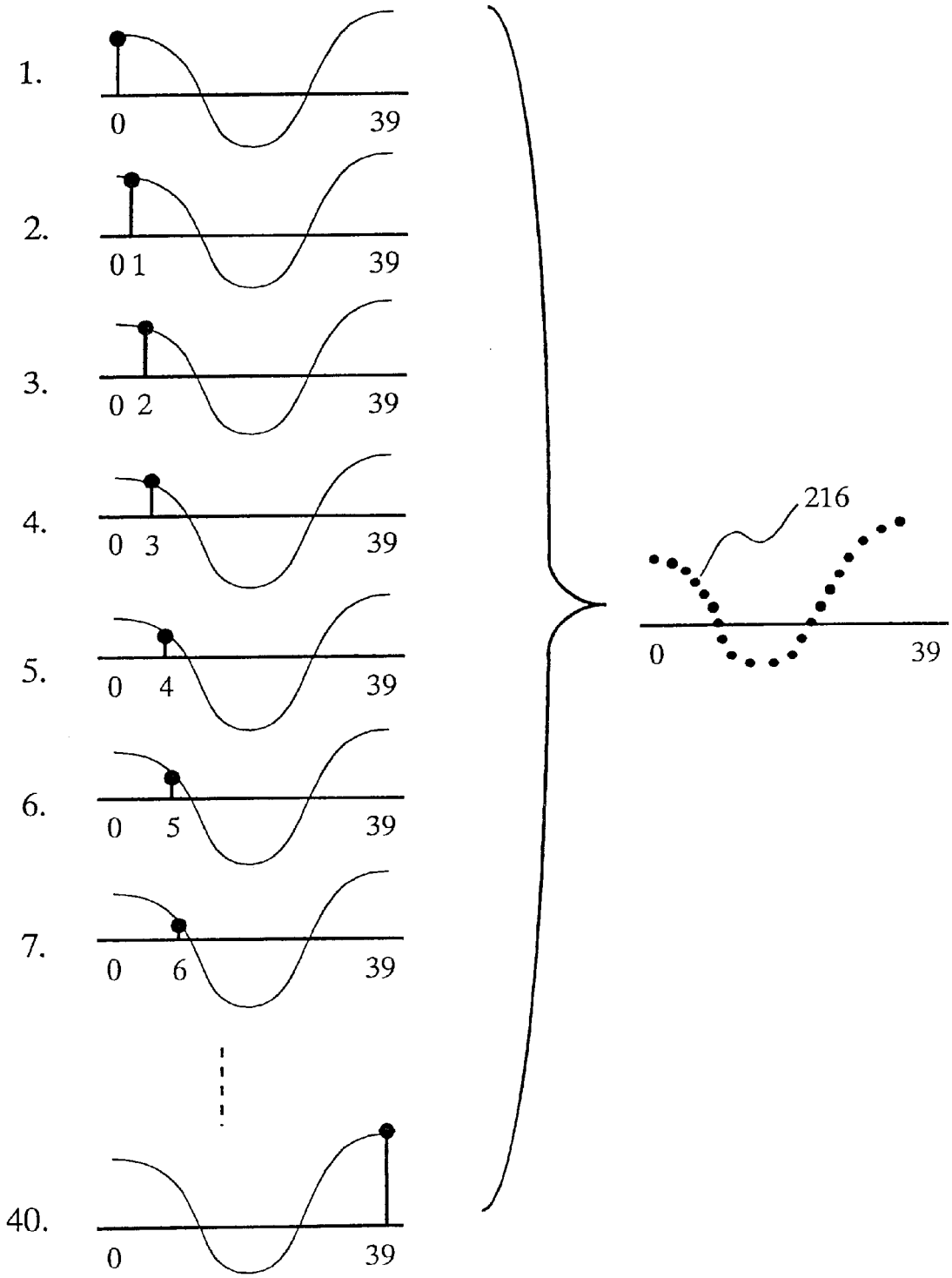
FIG. 27 illustrates a way of calculating a temporary gain, according to Embodiment 1 of the present invention.

As shown in FIG. 26, the pulse position search unit 41 reads pulse positions, one by one, stored in the pulse position codebook 23 corresponding to each pulse position code 230 shown in FIG. 15. Then, the pulse position search unit 41 generates a temporary pulse excitation 172*a* by setting a pulse which has the temporary gain 216, at each of the read pulse positions of specific number. A temporary synthetic signal 174 is generated by convolutionally calculating the temporary pulse excitation 172*a* and the impulse response 215. Then, a distance between the temporary synthetic signal 174 and the encoding-target signal 20 is calculated. This calculation is performed 8192 times (8×8×8×16) for all the combinations of the pulse positions One of the pulse position codes 230 which makes the distance shortest is output to a multiplexing unit 3, as a stochastic excitation code 19. The temporary pulse excitation 172*a* corresponding to the output pulse position code 230 is output to a gain coding unit 12 in a coding unit 1.

Figure 2:
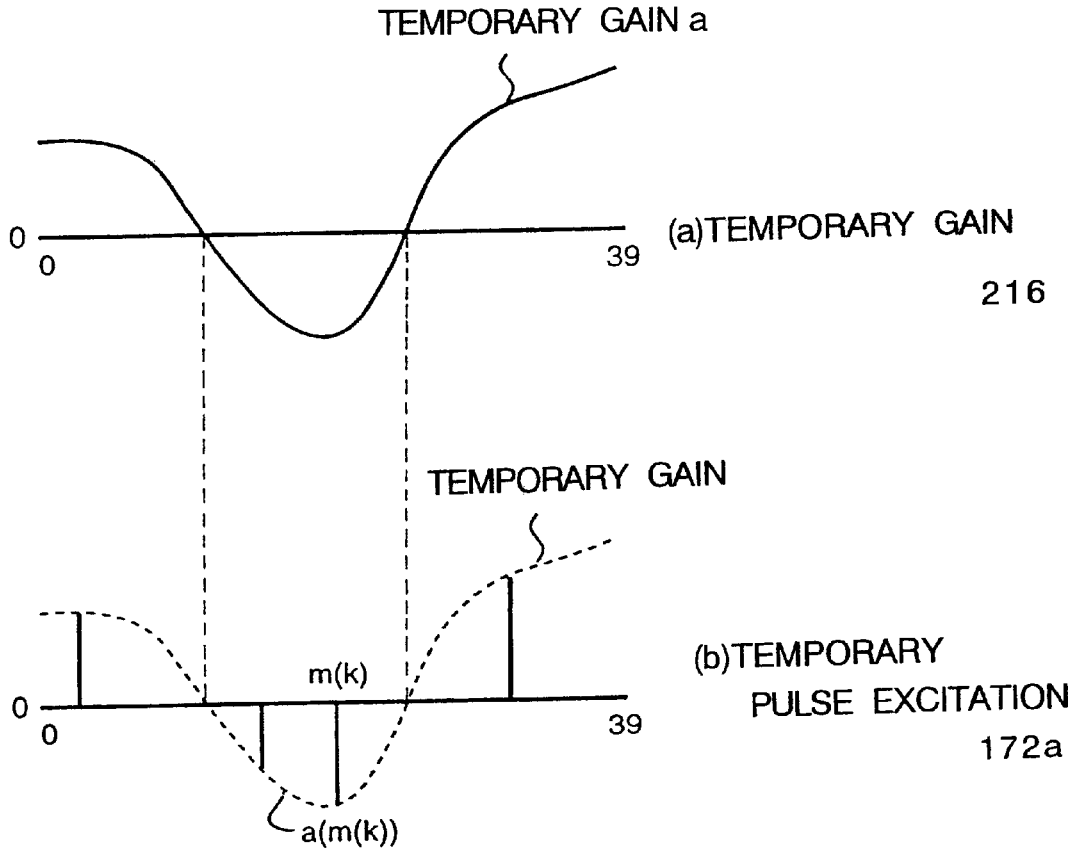
FIG. 2 illustrates lines for explaining a temporary gain calculated in a temporary gain calculating unit in FIG. 1 and a temporary pulse excitation generated in a pulse position search unit in FIG. 1.

FIG. 2 shows the temporary gain 216 calculated in the temporary gain calculating unit 40 and the temporary pulse excitation 172*a* generated in the pulse position search unit 41. The temporary gain 216*a* shown in (a) of FIG. 2 is calculated at each pulse position on the supposition that not four pulses but one pulse is set as the pulse excitation. The following expression (8) is one example of the calculation.

$$a(x)=d(x)/\phi \tag{8}$$

where, d(x) indicates correlation between an impulse response and an input speech when an impulse is set at a pulse position x.

$\phi$(x,y) indicates correlation between an impulse response when an impulse is set at a pulse position x, and an impulse response when an impulse is set at a pulse position y.

The most appropriate gain value when one pulse is set at the pulse position x is calculated by the expression (8). The temporary gain calculating unit 40 calculates a temporary gain at each pulse position of 40 samples (0 through 39) and outputs the calculated temporary gain to the pulse position search unit 41. When the temporary pulse excitation 172 a is generated by setting a pulse at a pulse position {m (k), k=1, . . . , 4} in the pulse position search unit 41 as shown in (b) of FIG. 2, each pulse is given a gain {a (m (k)), k=1, . . . , 4} by using the temporary gain 216 shown in (a) of FIG. 2.

The distance calculating method in the pulse position search unit 41 when a temporary gain a(x) is calculated as described above will now be explained. This distance calculating method is similar to the method of article 1 in the point that searching is performed by means of the calculation D for all the combinations of the pulse positions, depending upon to get the shortest distance equals to get the largest D in the expression (1). However, in Embodiment 1, g(k) in the expressions (2) and (3) is substituted for a(m(k)) defined in the expression (8) in order to simplify the calculation. The simplified expressions corresponding to the expressions (2) and (3) are as follows:

$$C=\sum_k d'(m(k)) \tag{9}$$

$$E=\sum_k\sum_i \phi'(m(k),m(i)) \tag{10}$$

where, $d'(m(k))=a(m(k))d(m(k))$ (11)

$\phi'(m(k),m(i))=a(m(k))a(m(i)\phi(m(k),m(i))$ (12)

m(k): pulse position of kth pulse

Accordingly, if the calculations of d' and $\phi$ are finished before starting the calculation of D for all the combinations of pulse positions, D is obtained by small amount of calculation, that is simple addition stated in the expressions (9) and (10).

When the pulse position search is performed by using the temporary gain 216 as stated above, it is necessary to provide a configuration in which an independent gain is added to each pulse, in the provided gain coding unit 12.

Figure 22:
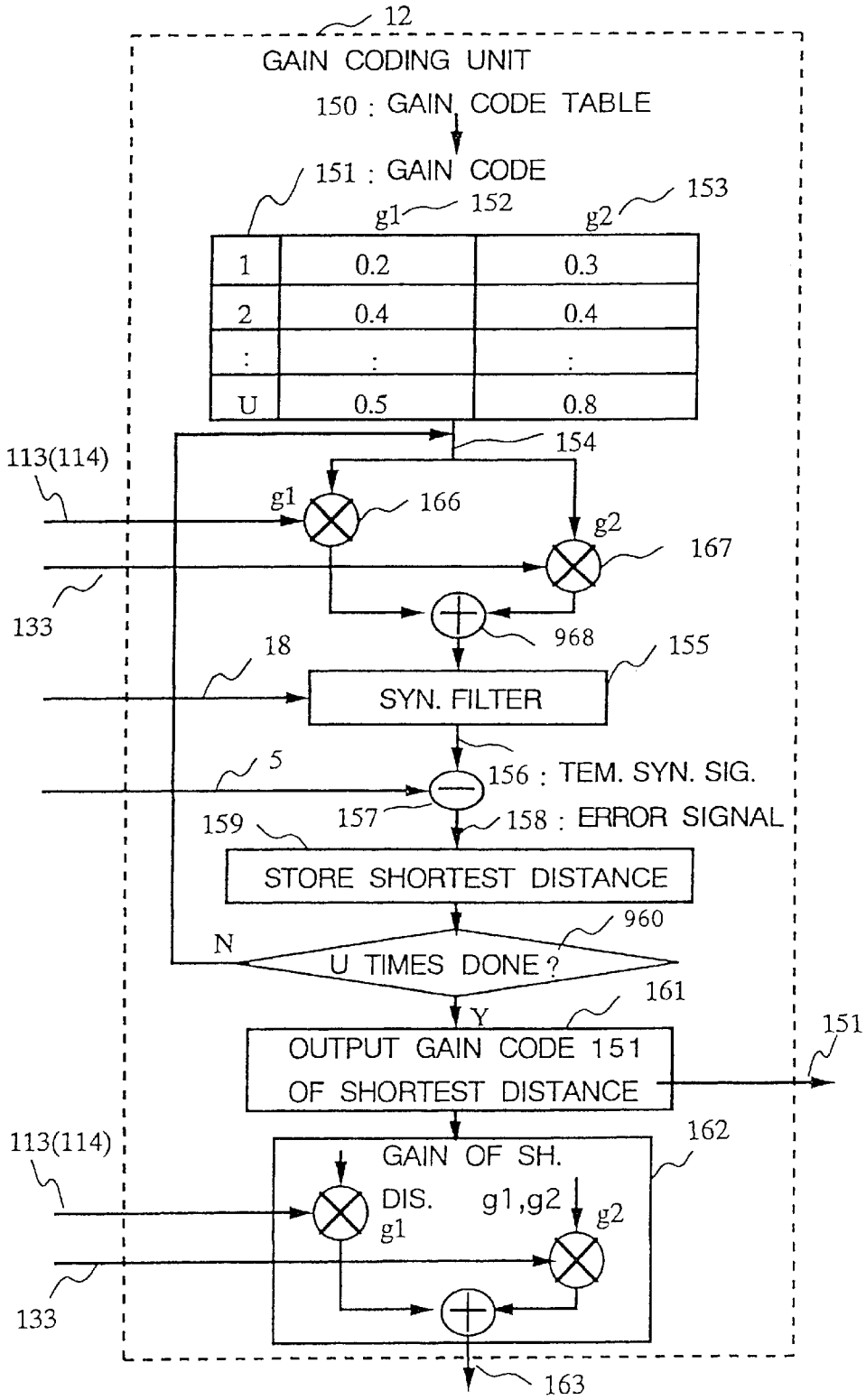
Fig.22 PRIOR ART
FIG. 22 shows the operation of a conventional gain excitation signal coding unit.
Figure 23:
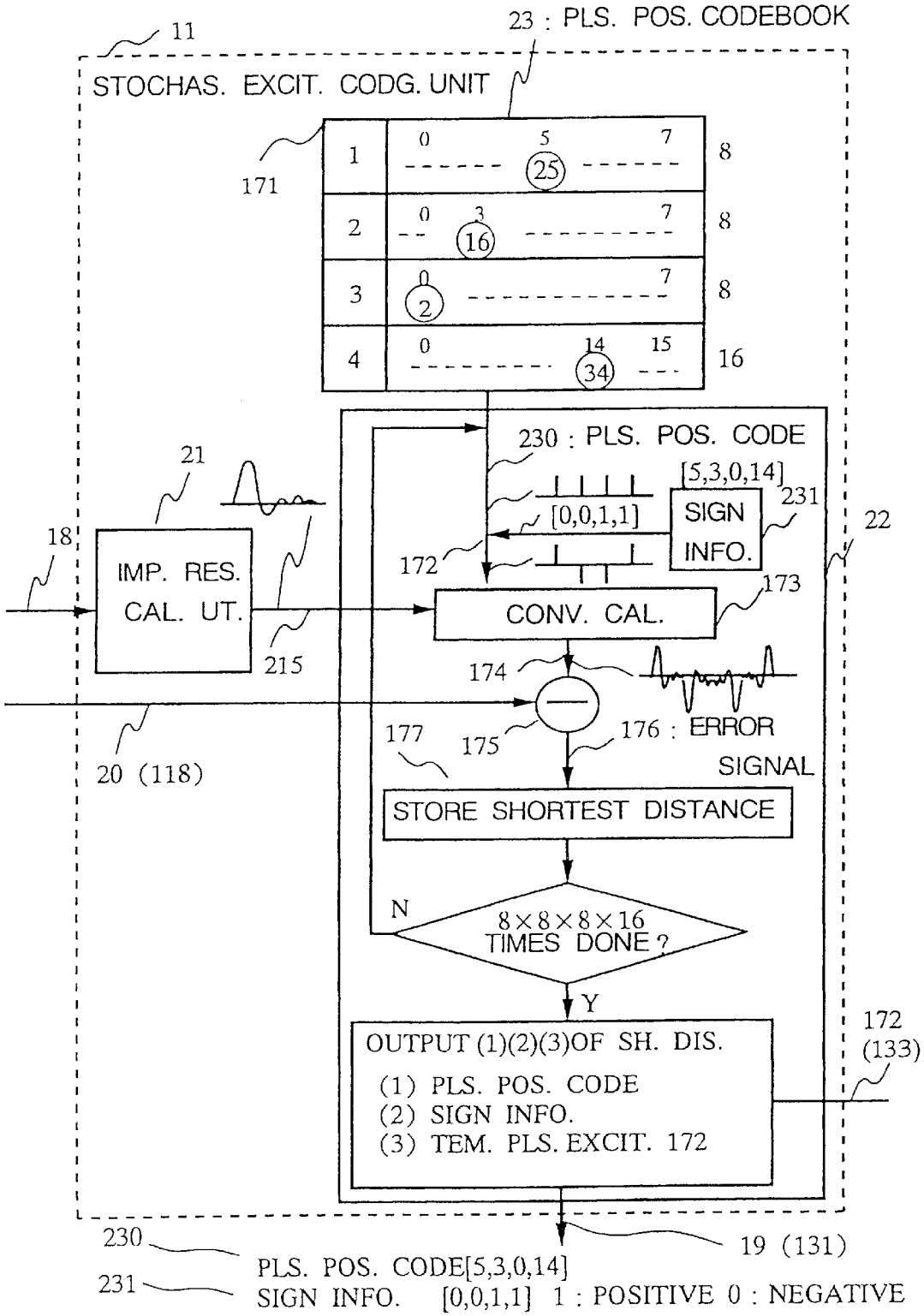
Fig.23 PRIOR ART
FIG. 23 shows the operation of a conventional stochastic excitation coding unit.
Figure 24:
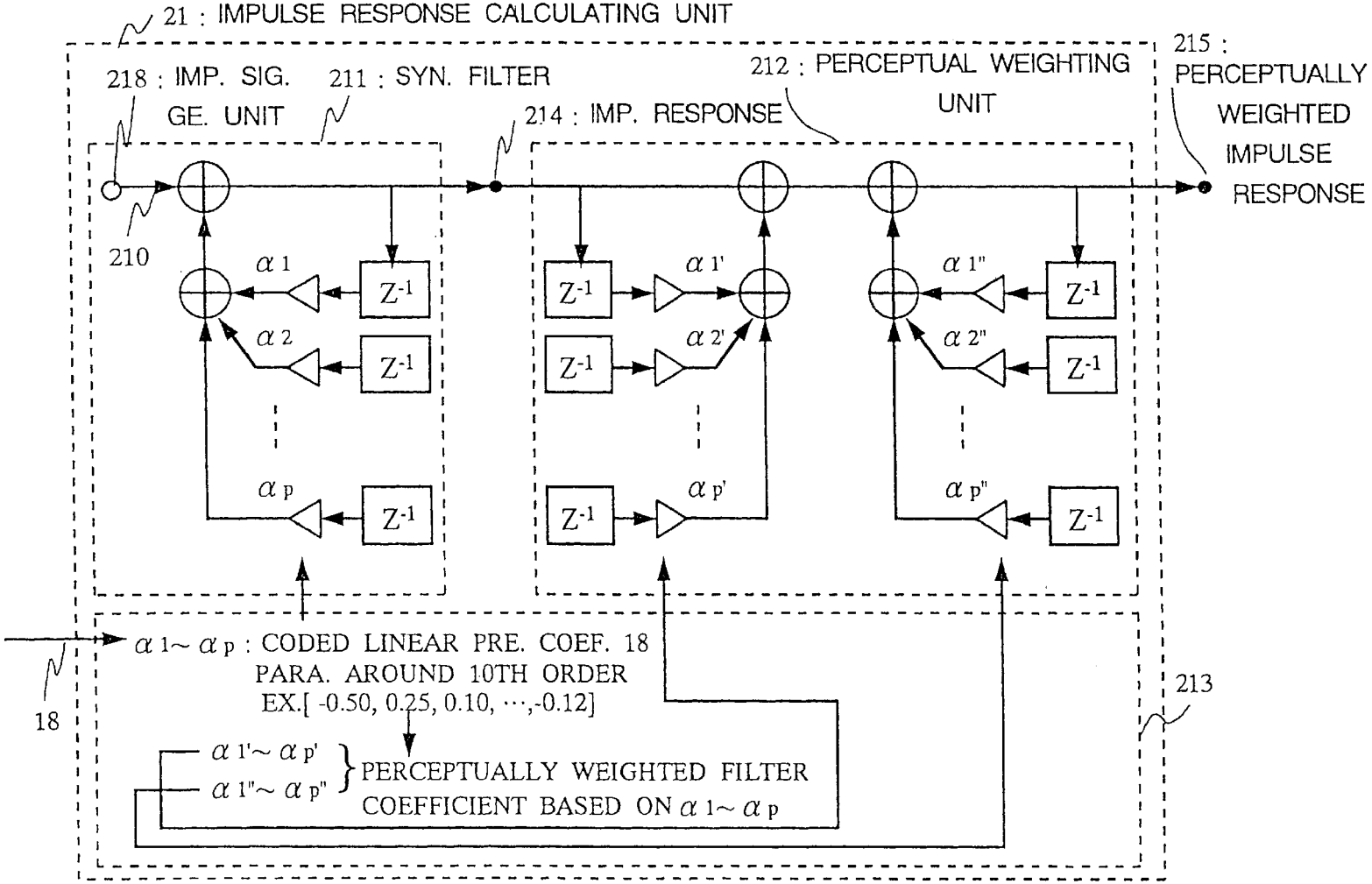
Fig.24 PRIOR ART
FIG. 24 shows the operation of a conventional impulse response calculating unit.
Figure 25:
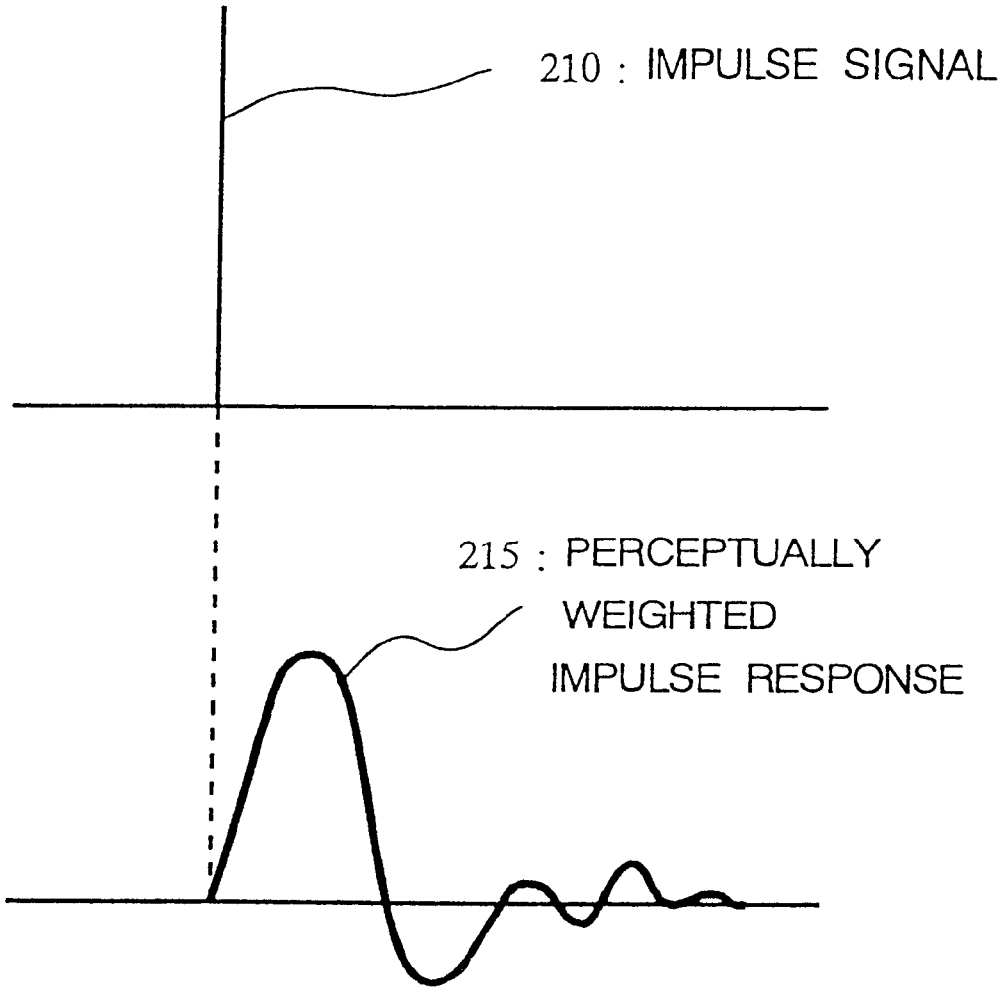
Fig.25 PRIOR ART
FIG. 25 shows a conventional impulse signal and impulse response.
Figure 28:
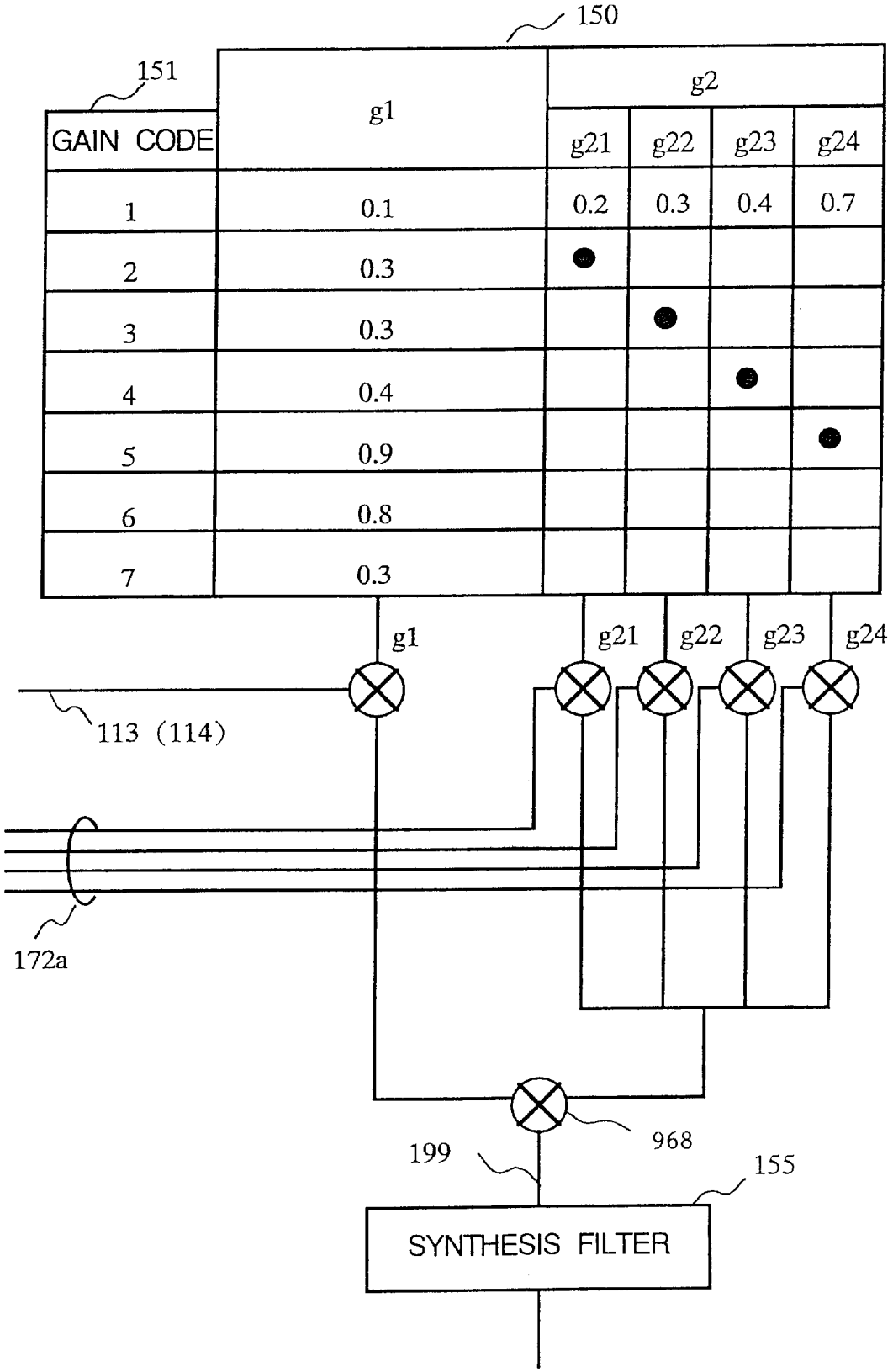
FIG. 28 shows the operation of a part of a gain excitation signal coding unit according to Embodiment 1 of the present invention.

FIG. 28 shows an example of a gain codebook 150 of the gain coding unit 12 in the case of four pulses being set. A gain search unit 160 inputs an adaptive excitation 113 from an adaptive excitation coding unit 10 and the temporary pulse excitation 172*a* from the stochastic excitation coding unit 11. A temporary excitation signal 199 is generated by multiplying the adaptive excitation 113 by a gain g1 in the gain codebook 150, multiplying the four pulses in the temporary pulse excitation 172*a* by gains g21 through g24, and adding the multiple signals. Then, operations similar to those after a process of synthesis filter 155 shown in FIG. 22 are performed in order to obtain a gain code 151 which makes the shortest distance. The adoptive excitation 113 by a gain g1 in the gain codebook 150, multiplying the four pulses in the temporary pulse excitation 172*a* by gains g21 through g24, and adding the multiplied signals.

As stated above, a temporary gain for each of the pulse positions is calculated before the pulse positions are determined, and the pulse positions are determined by generating the temporary pulse excitations 172*a* whose pulse amplitudes are different, based on the temporary gains, in the speech coding/decoding apparatus according to Embodiment 1. Accordingly, when the independent gain is finally added at each pulse, approximation accuracy of the gain in the pulse position searching is enhanced, in the gain coding unit 12. Therefore, it becomes easy to find the most appropriate pulse position, and consequently the encoding characteristic is improved. It is difficult to determine the appropriate pulse position in the conventional art because amplitudes of the pulses are fixed. In addition, according to Embodiment 1, the supplemented calculation amount in searching pulse positions can be less than that of prior arts.

Embodiment 2

Figure 3:
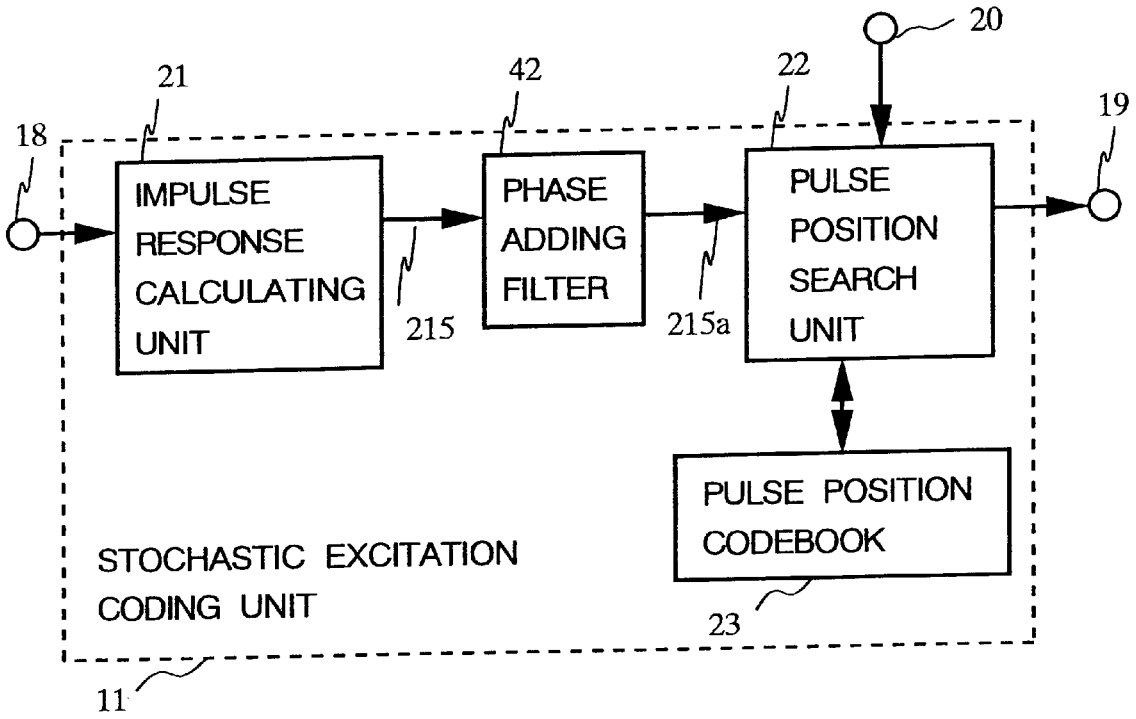
FIG. 3 is a block diagram showing a stochastic excitation coding unit in a speech coding/decoding apparatus according to Embodiment 2 of the present invention.
Figure 4:
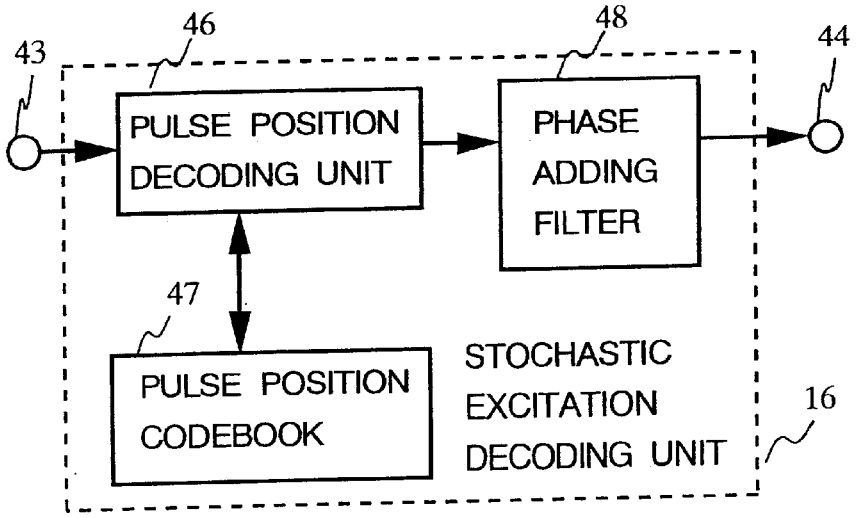
FIG. 4 is a block diagram showing a stochastic excitation decoding unit in the speech coding/decoding apparatus according to Embodiment 2 of the present invention.
Figure 13:
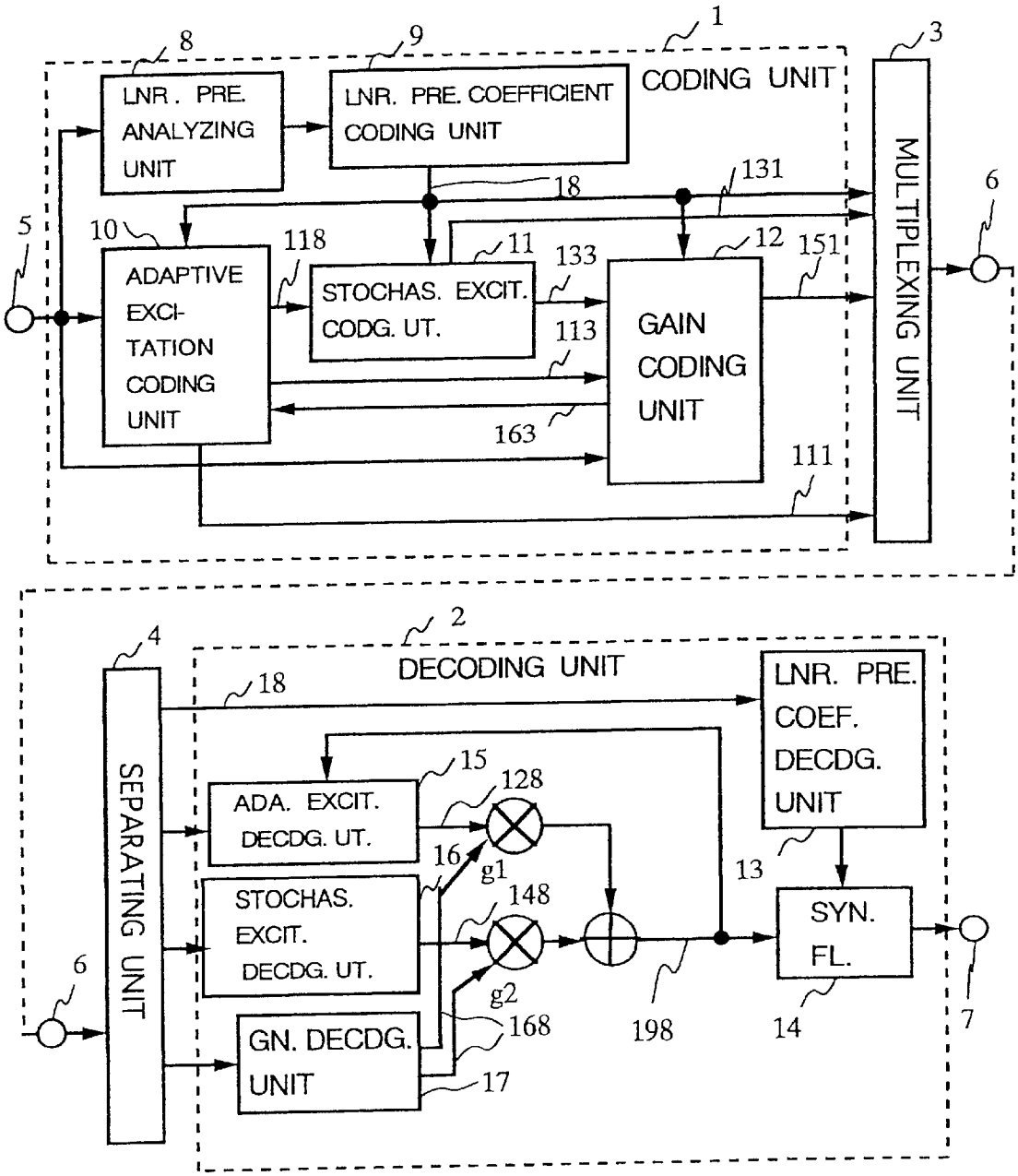
Fig.13 PRIOR ART
FIG. 13 is a block diagram showing a whole configuration of a conventional "celp" speech coding/decoding apparatus.
Figure 14:
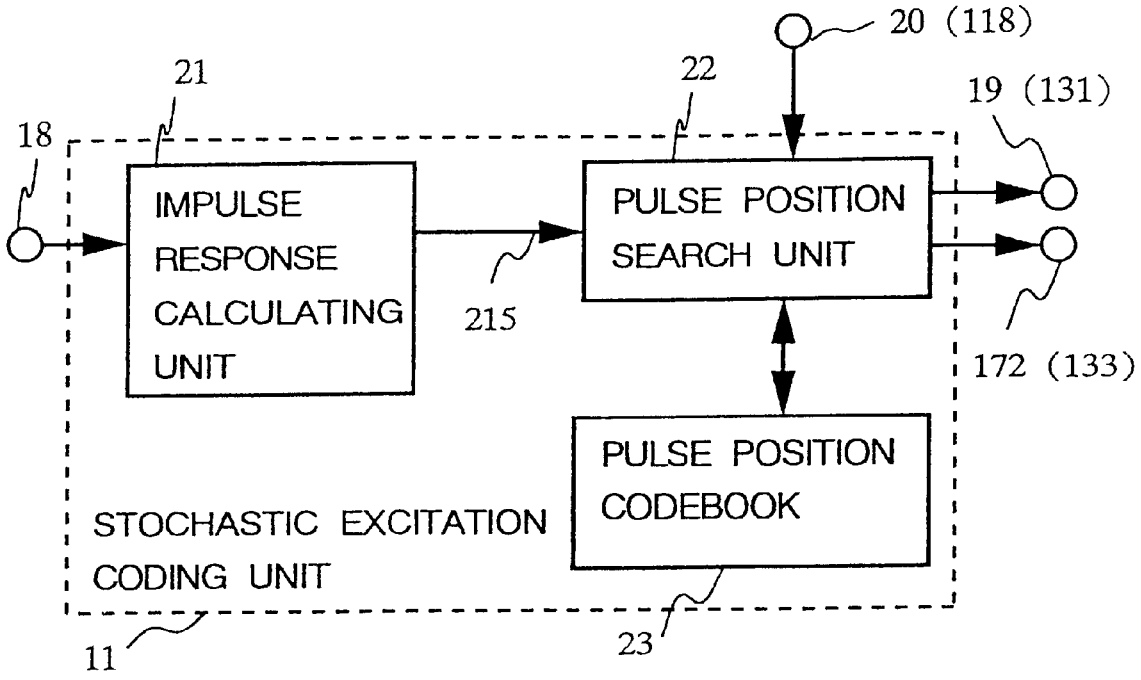
FIG.14 PRIOR ART
FIG. 14 is a block diagram showing a configuration of a stochastic excitation coding unit used in a conventional speech coding/decoding apparatus.
Figure 16:
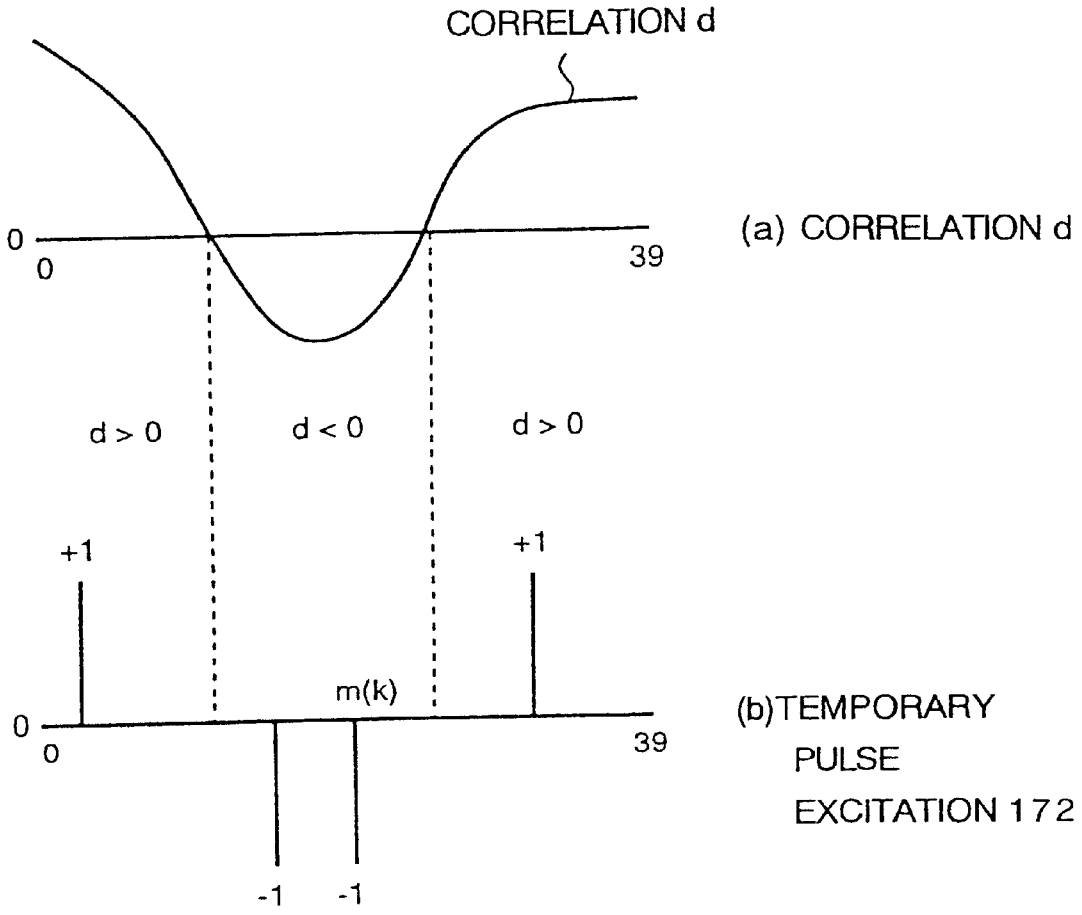
Fig.16 PRIOR ART
FIG. 16 illustrates lines for explaining a temporary pulse excitation generated in a conventional pulse position search unit.

According to Embodiment 2 of the present invention, FIG. 3 shows a configuration of the stochastic excitation coding unit 11 shown in the speech coding/decoding apparatus of FIG. 13. The reference numbers in FIG. 3 are labeled correspondingly to those in FIG. 14. FIG. 4 shows a stochastic excitation decoding unit 16 of the Embodiment 2, which is shown in the speech coding/decoding apparatus of FIG. 13.

In FIGS. 3 and 4, phase adding filters 42 and 48, a stochastic excitation code 43, a stochastic excitation 44, a pulse position decoding unit 46 and a pulse position codebook 47, having the same configuration as the pulse position codebook 23 in the coding unit 1, are shown.

The phase adding filter 42 in the coding unit 1 performs filtering to give a phase characteristic to the impulse response 215, which easily generates a specific phase relation, output from the impulse response calculating unit 21. Namely, phase shifting is performed for each frequency, and an impulse response 215 a close to the real position relation is output. The pulse position decoding unit 46 in a decoding unit 2 reads pulse position data in the pulse position codebook 47, based on the stochastic excitation 43. A plurality of pulses having signs defined by the stochastic excitation code 43 is set based on the pulse position data, and the set pulses are output as a stochastic excitation. The phase adding filter 48 performs filtering to give a phase characteristic to the stochastic excitation, and a signal generated by the filtering is output as the stochastic excitation 44.

It is acceptable to add a fixed pulse waveform, similar to article 5, as the phase characteristic for the excitation signal, or to use a quantized phase amplitude characteristic disclosed in Japanese Patent Application 6-264832. As the phase characteristic for the excitation signal, it is also acceptable to pick up a part of old excitation signal, to average parts of old excitation signal, or to treat with the temporary gain calculating unit 40 in Embodiment 1.

As stated above, the coding unit in the speech coding/decoding apparatus according to Embodiment 2 encodes the excitation signal into plural pulse excitation positions and excitation signal gains, by using the impulse response which is given the phase characteristic for the excitation signal. Then, the excitation signal phase characteristic is added to the excitation signal in the decoding unit in the speech coding/decoding apparatus according Embodiment 2. Accordingly, it is possible to add the phase characteristic to the excitation signal without increasing the calculation amount for obtaining the distance at each excitation signal position combination. Even if the number of the pulse position combinations increases, it is possible to perform coding/decoding for the excitation signal which is given the phase characteristic, as long as the calculation amount is practically realized. Therefore, the coding quality is improved because the quality in representing excitation signals is increased.

Embodiment 3

Figure 5:
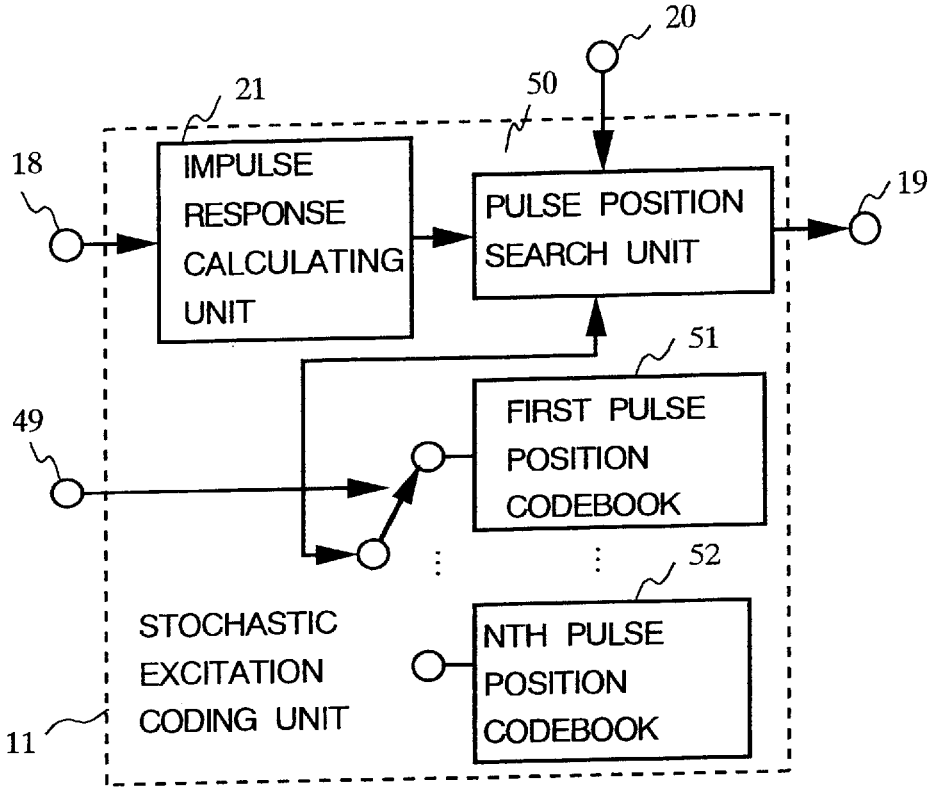
FIG. 5 is a block diagram showing a stochastic excitation coding unit in a speech coding/decoding apparatus according to Embodiment 3 of the present invention.
Figure 6:
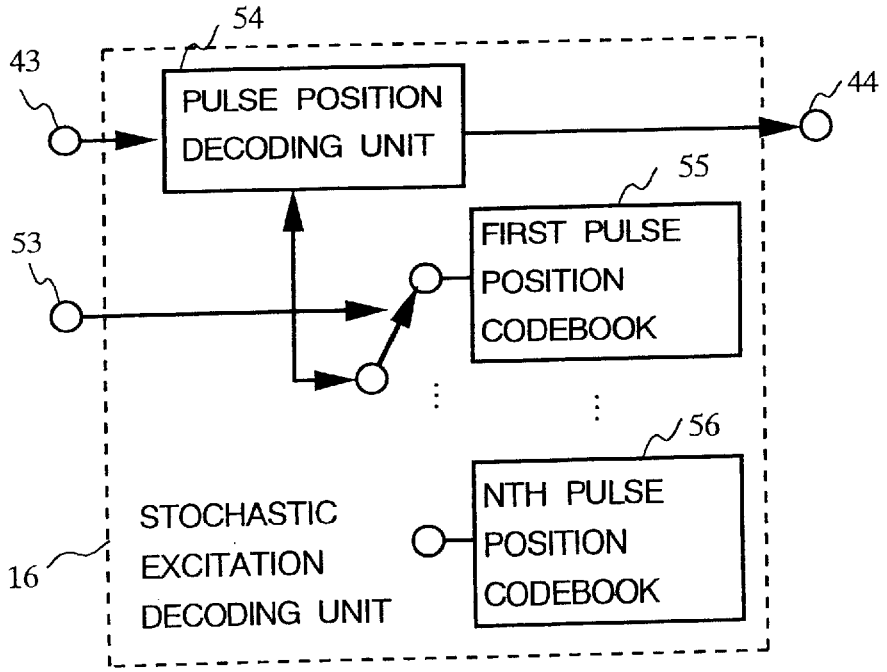
FIG. 6 is a block diagram showing a stochastic excitation decoding unit in the speech coding/decoding apparatus according to Embodiment 3 of the present invention.

FIG. 5 shows the stochastic excitation coding unit 11 in the speech coding/decoding apparatus, as shown in FIG. 13, according to Embodiment 3. Reference numbers in FIG. 5 are correspondingly labeled to those FIGS. 3 and 4. FIG. 6 shows the stochastic excitation decoding unit 16. The whole configuration of the speech coding/decoding apparatus according to Embodiment 3 is the same as FIG. 13.

In FIGS. 5 and 6, pitch periods 49 and 53, a pulse position search unit 50, first pulse position codebooks 51 and 55, nth pulse position codebooks 52 and 56, and a pulse position decoding unit 54 are shown.

In the stochastic excitation coding unit 11, one pulse position codebook out of N pulse position codebooks (the first pulse position codebook 51 through the Nth pulse position codebook 52) is selected based on the pitch period 49. It is acceptable to use a repetitive period of the adaptive excitation as the pitch period or to use a pitch period calculated by other analysis. However, in the case of the pitch period calculated by other analysis being used, it is necessary to encode the pitch period and provide the encoded pitch period to the stochastic excitation decoding unit 16 in the decoding unit 2.

The pulse position search unit 50 reads a pulse position, stored in the selected pulse position codebook corresponding to each pulse position code, one by one, sets a pulse having a specific amplitude and an appropriate sign at each of pulse positions of the read specific number, and generates a temporary pulse excitation by performing a pitch synchronization process based on the value of the pitch period 49. Then, a temporary synthetic signal is generated by convolutionally calculating the temporary pulse excitation and the impulse response. The distance between the temporary synthetic signal and the encoding-target signal 20 is calculated. One of the pulse position codes which makes the distance shortest is output as the stochastic excitation code 19. In addition, a temporary pulse excitation corresponding to the pulse position code is output to the gain coding unit 12 in the coding unit 1.

In the stochastic excitation decoding unit 16, one pulse position codebook out of N pulse position codebooks (the first pulse position codebook 51 through the Nth pulse position codebook 52) is selected based on the pitch period 53. The pulse position decoding unit 46 reads pulse position data in the selected pulse position codebook, based on the stochastic excitation code 43, sets plural pulses having signs appointed by the stochastic excitation code 43, based on the pulse position data, and outputs the data as the stochastic excitation 44 after performing a pitch synchronization process based on the value of the pitch period 53.

FIG. 7 shows the first pulse position codebook 51 through the Nth pulse position codebook 52 used in the case of the frame length of the excitation signal for encoding being eighty samples.

Figure 29:
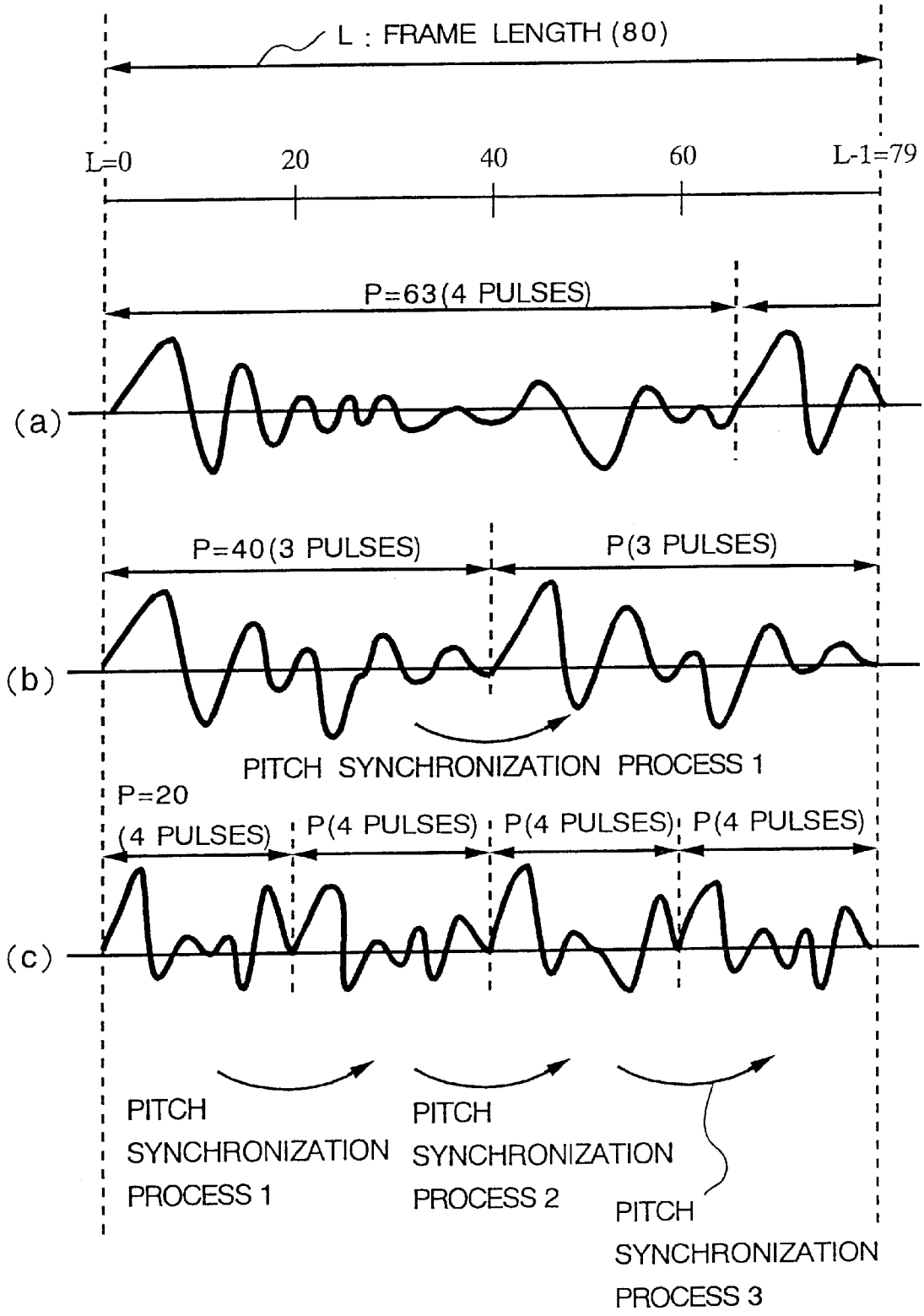
FIG. 29 illustrates a pitch synchronization process according to Embodiment 3 of the present invention.

(a) of FIG. 7 is the first pulse position codebook used when the pitch period p is larger than 48 as shown in (a) of FIG. 29. The stochastic excitation of eighty samples is composed of four pulses, and no pitch synchronization process is performed. The information amount for each pulse position is totally 17 bits, that is 4 bits, 4 bits, 4 bits, and 5 bits from the top to the bottom.

(b) of FIG. 7 is the second pulse position codebook, used when the pitch period p is larger than 32 and equal to or smaller than 48, as shown in (b) of FIG. 29. The stochastic excitation of forty-eight samples, at most, is composed of three pulses. The stochastic excitation of eighty samples is generated by performing the pitch synchronization process once. The stochastic excitation of eighty samples can be composed of six pulses at the most, by using this codebook. The information amount for each pulse position is totally 12 bits, that is 4 bits, 4 bits, and 4 bits from the top to the bottom. If it is necessary to additionally encode the pitch period and the pitch period is encoded at 5 bits, it totally can be 17 bits.

(c) of FIG. 7 is the third pulse position codebook used when the pitch period p is equal to or smaller than 32, as shown in (c) of FIG. 29. The stochastic excitation of thirty-two samples, at most, is composed of four pulses. The stochastic excitation of eighty samples is generated by performing the pitch synchronization process three times. The stochastic excitation of eighty samples can be composed of sixteen pulses in the case of the pitch period being 20 by using this codebook. The information amount for each pulse position is totally 12 bits, that is 3 bits, 3 bits, 3 bits and 3 bits from the top to the bottom. If it is necessary to additionally encode the pitch period and the pitch period is encoded at 5 bits, it totally can be 17 bits.

Figure 17:
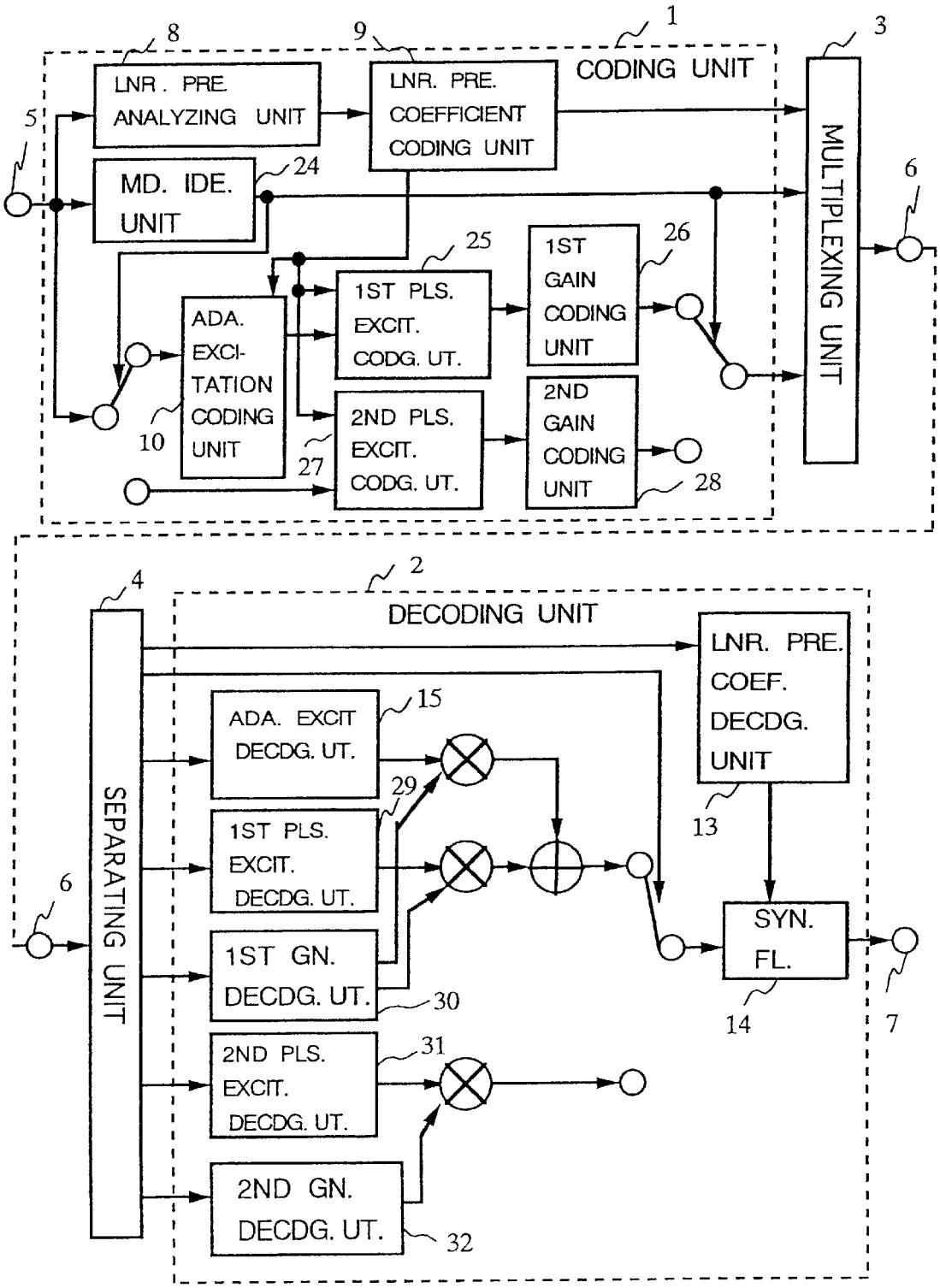
Fig.17 PRIOR ART
FIG. 17 is a block diagram showing a whole configuration of a conventional speech coding/decoding apparatus.
Figure 18:
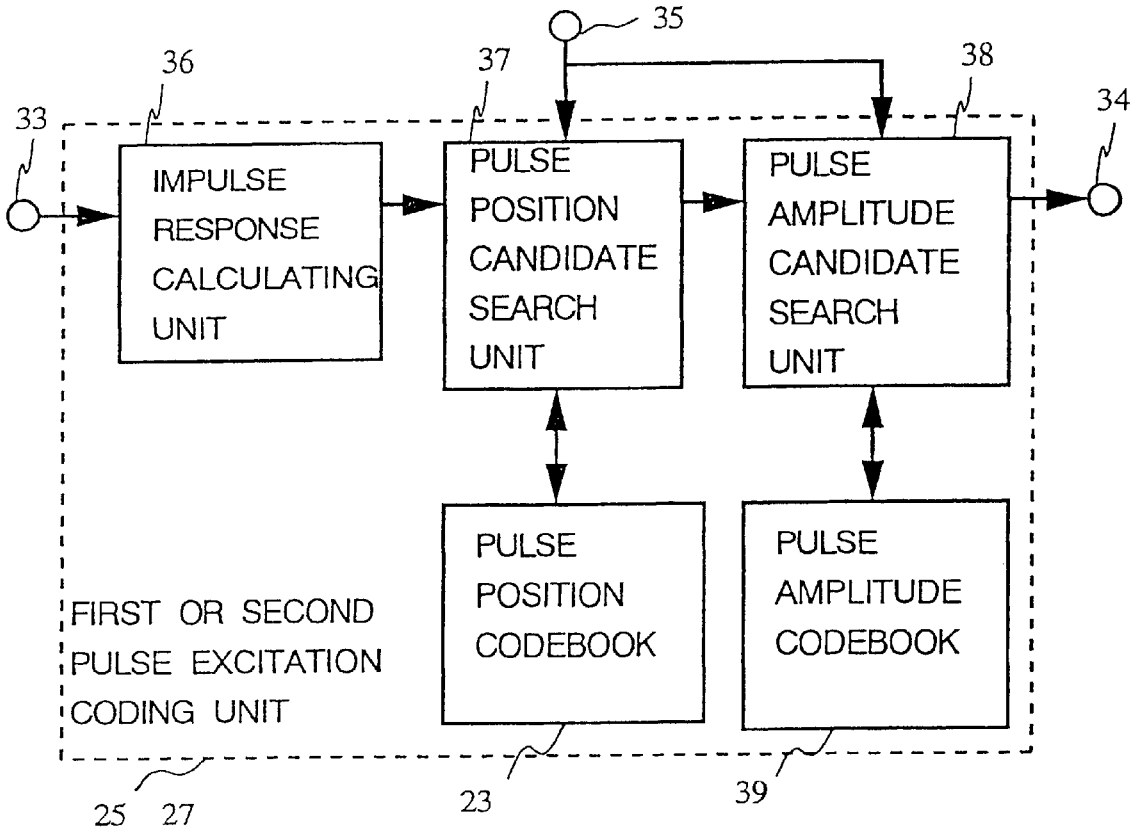
Fig.18 PRIOR ART
FIG. 18 is a block diagram showing a configuration of the first pulse excitation coding unit and the second pulse excitation coding unit in a conventional speech coding/decoding apparatus.
Figure 19:
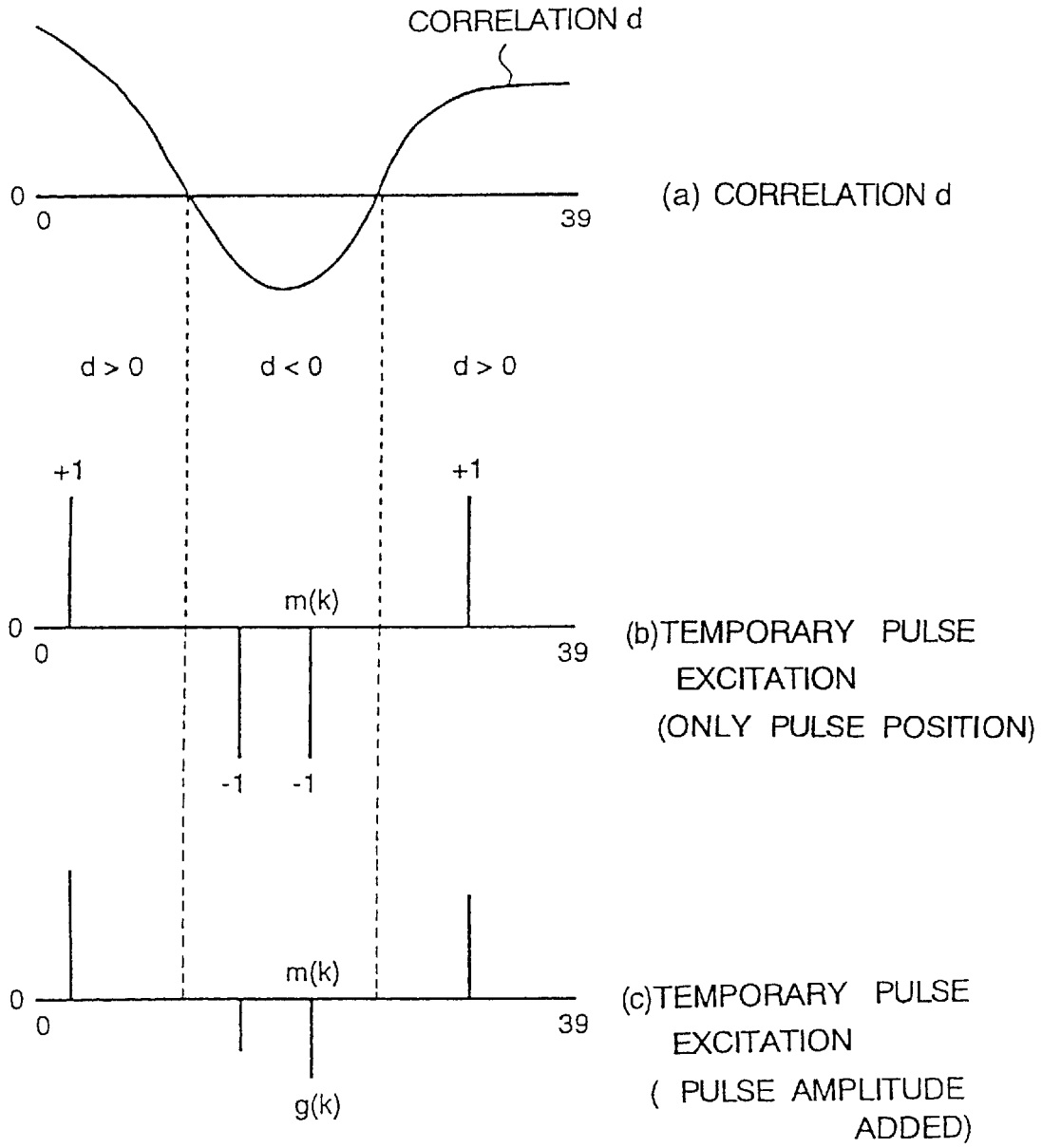
Fig.19 PRIOR ART
FIG. 19 illustrates lines for explaining a temporary pulse excitation generated in a pulse position candidate search unit and a temporary pulse excitation to which a pulse amplitude is added in a pulse amplitude candidate search unit, in a conventional speech coding/decoding apparatus.

In FIG. 7, the number of pulses is defined on the supposition that the pitch period is encoded by using another method. However, when a repetitive period of the adaptive excitation is used as the pitch period, it is possible to further increase the number of pulses in (b) and (c) of FIG. 7 This case, indicating the repetitive period is used as the pitch period, depends upon the frame length and the total bit number. Comparing with the conventional case of (a) of FIG. 7, the number of necessary bits for one pulse is decreased because the pulse range can be restricted to around the length of the pitch period. Consequently, it is possible to increase the number of pulses in the case that the total bit number is fixed. The configuration for encoding the pitch period by another method is effective when the excitation signal is encoded by using only algebraic excitation, as the second excitation signal coding mode explained in FIG. 17.

As stated above, in the coding unit of the speech coding/decoding apparatus according to Embodiment 3, the number of excitation signal pulses is increased by restricting excitation signal position candidates to be within the pitch period when the pitch period is equal to or smaller than a specific value. Consequently, the coding quality is improved because the quality in representing excitation signals is increased. It is also possible to encode the pitch period by another method without much decreasing the number of pulses. Even the part, where the coding characteristics with using the adaptive excitation is bad, can be encoded by using the pitch periodic algebraic excitation. Therefore, the coding quality is improved.

Embodiment 4

FIG. 8 shows a pulse position codebook used in the speech coding/decoding apparatus according to Embodiment 4 of the present invention. The whole configuration of the speech coding/decoding apparatus of Embodiment 4 is the same as FIG. 13, the stochastic excitation coding unit 11 is the same as FIG. 5, the stochastic excitation decoding unit 16 is the same as FIG. 6 and the initial pulse position codebook is the same as FIG. 7.

When the pitch period p is equal to or less than 32, the third pulse position codebook shown in (c) of FIG. 7 is selected in the stochastic excitation coding unit 11 and the stochastic excitation decoding unit 16. In this Embodiment 4, the third pulse position codebook as shown in (a) of FIG. 8 is used when the pitch period is 32.

However, when the pitch period is less than 32, the pulse position equal to or more than the pitch period length is not selected. The part of this non-selected pulse position is used after it is redefined to be a pulse position less than the pitch period length. (b) of FIG. 8 shows a pulse position codebook, in which a pulse excitation position 300, not selected when the pitch period p is 20, has been reset to be a pulse excitation position 310 less than the pitch period length. Namely, all the pulse excitation positions 300 equal to or more than 20 in the third pulse position codebook of (c) of FIG. 7, are reset to be the pulse excitation position 310 less than 20 as shown in (b) of FIG. 8. There can be various methods for resetting, as long as no more identical pulse position is reset for one pulse position in a pulse number. In FIG. 8, a method of replacing to a pulse excitation position 311 assigned for the next pulse number is applied as shown by the arrows.

As stated above, the code indicating a pulse excitation position larger than the pitch period is reset to indicate a pulse excitation position within the pitch period. Since the code for unused pulse position is excluded, all the coding information becomes effective. Consequently, the coding quality is improved.

Embodiment 5

Figure 9:
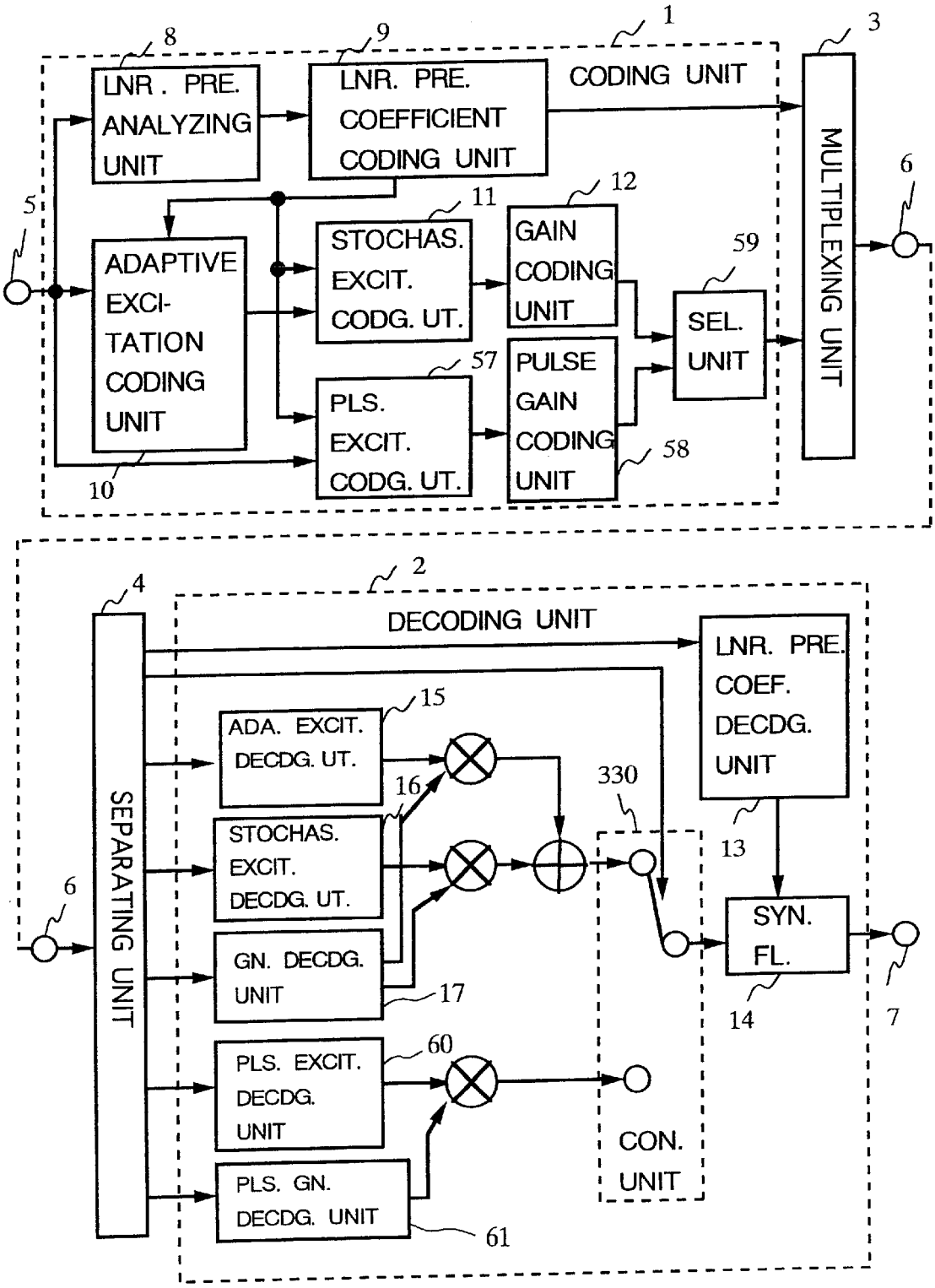
FIG. 9 is a block diagram showing a whole configuration of a speech coding/decoding apparatus according to Embodiment 5 of the present invention.

FIG. 9, labeled correspondingly to FIG. 13, shows the speech coding/decoding apparatus according to Embodiment 5. In FIG. 9, a pulse excitation coding unit 57, a pulse gain coding unit 58, a selecting unit 59, a pulse excitation decoding unit 60, a pulse gain decoding unit 61 and a controlling unit 330 are shown.

Comparing with FIG. 13, the newly added operations are described below. The pulse excitation coding unit 57 generates a temporary pulse excitation corresponding to each pulse excitation code. Then, the temporary pulse excitation is multiplied by an appropriate gain. The multiplied temporary pulse excitation is filtered by using a synthesis filter, in which a linear predictive coefficient output from a linear predictive coefficient coding unit 9 is applied, in order to generate a synthetic signal. A distance between the temporary synthetic signal and an input speech 5 is calculated, and one of pulse excitation codes which makes the distance shortest is selected. Some pulse excitation codes, having a closer distance to the shortest distance, are searched in the order of distance from the closest to farthest, as pulse excitation code candidates. A temporary pulse excitations corresponding to each of the pulse excitation code candidates is output.

The pulse gain coding unit 58 generates a temporary pulse gain vector corresponding to each gain code. Then, each pulse of the temporary pulse excitation is multiplied by each element of each pulse gain vector. The multiplied temporary pulse excitation is filtered by using the synthesis filter, in which the linear predictive coefficient output from the linear predictive coefficient coding unit 9 is applied, in order to generate a synthetic signal. A distance between the temporary synthetic signal and the input speech 5 is calculated. One of temporary pulse excitations and one of gain codes, which make the distance shortest, are selected. Then, a pulse excitation code corresponding to the selected gain code and the selected temporary pulse excitation are output.

The selecting unit 59 compares the shortest distance obtained in the gain coding unit 12 with the shortest distance obtained in the pulse gain coding unit 58, and selects one of the two making the shorter. Depending upon this selection, one mode of a first excitation signal coding mode, composed of the adaptive excitation coding unit 10, the stochastic excitation coding unit 11 and the gain coding unit 12, and a second mode, composed of the pulse excitation coding unit 57 and the pulse gain coding unit 58, is switched to be in use.

The multiplexing unit 3, in the case of the first excitation signal coding mode being used, multiplexes a code of the linear predictive coefficient, selection information, an adaptive excitation code, a stochastic excitation code and a gain code, and outputs a multiplexed code 6. In the case of the second excitation signal coding mode being used, the multiplexing unit 3 multiplexes the code of linear predictive coefficient, the selection information, a pulse excitation code and a pulse gain code, and outputs the multiplied code 6.

When the selection information is in the first excitation signal coding mode, a separating unit 4 separates the code 6 into the code of the linear predictive coefficient, the selection information, the adaptive excitation code, the stochastic excitation code and the gain code. When the selection information is in the second excitation signal coding mode, the separating unit 4 separates the code 6 into the code of the linear predictive coefficient, the selection information, the pulse excitation code and the pulse gain code.

When the selection information is in the first excitation signal coding mode, an adaptive excitation decoding unit 15 outputs a time series vector, made by periodically repeating an old excitation signal, based on the adaptive excitation code. The stochastic excitation decoding unit 16 outputs a time series vector based on the stochastic excitation code, and a gain decoding unit 17 outputs a gain vector based on the gain code. An excitation signal is generated in the decoding unit 2 by multiplying the two time series vectors by each element of the gain vector, and adding these multiplied values. The excitation signal is filtered by using a synthesis filter 14 to be an output speech 7.

When the selection information is in the second excitation signal coding mode, the pulse excitation decoding unit 60 outputs a pulse excitation corresponding to the pulse excitation code. The pulse gain decoding unit 61 outputs a pulse gain vector corresponding to the gain code. An excitation signal is generated in the decoding unit 2 by multiplying each pulse of the pulse excitation by each element of the pulse gain vector. This excitation signal is filtered by using the synthesis filter 14 to be the output speech 7. Depending upon the selection information, the controlling unit 330 switches the output based on the first excitation signal coding mode to the output based on the second excitation signal coding mode.

As stated above, in this Embodiment 5, the excitation signal coding is performed by using both the first excitation signal coding mode, in which the excitation signal is encoded by plural pulse excitation positions and excitation signal gains, and the second excitation signal coding mode, which is different from the first mode. On the other hand, only one of the above modes is processed in the conventional case shown in FIG. 17. Then, in Embodiment 5, one of the excitation signal coding modes which leads the smaller encoding-distortion is selected. Consequently, the mode which leads the best coding characteristic is selected to improve the coding quality. It is also acceptable to apply the configurations of the stochastic excitation coding unit 11 and the pulse excitation coding unit 57 described in Embodiments 1 through 4 for those in Embodiment 5

Embodiment 6

Figure 10:
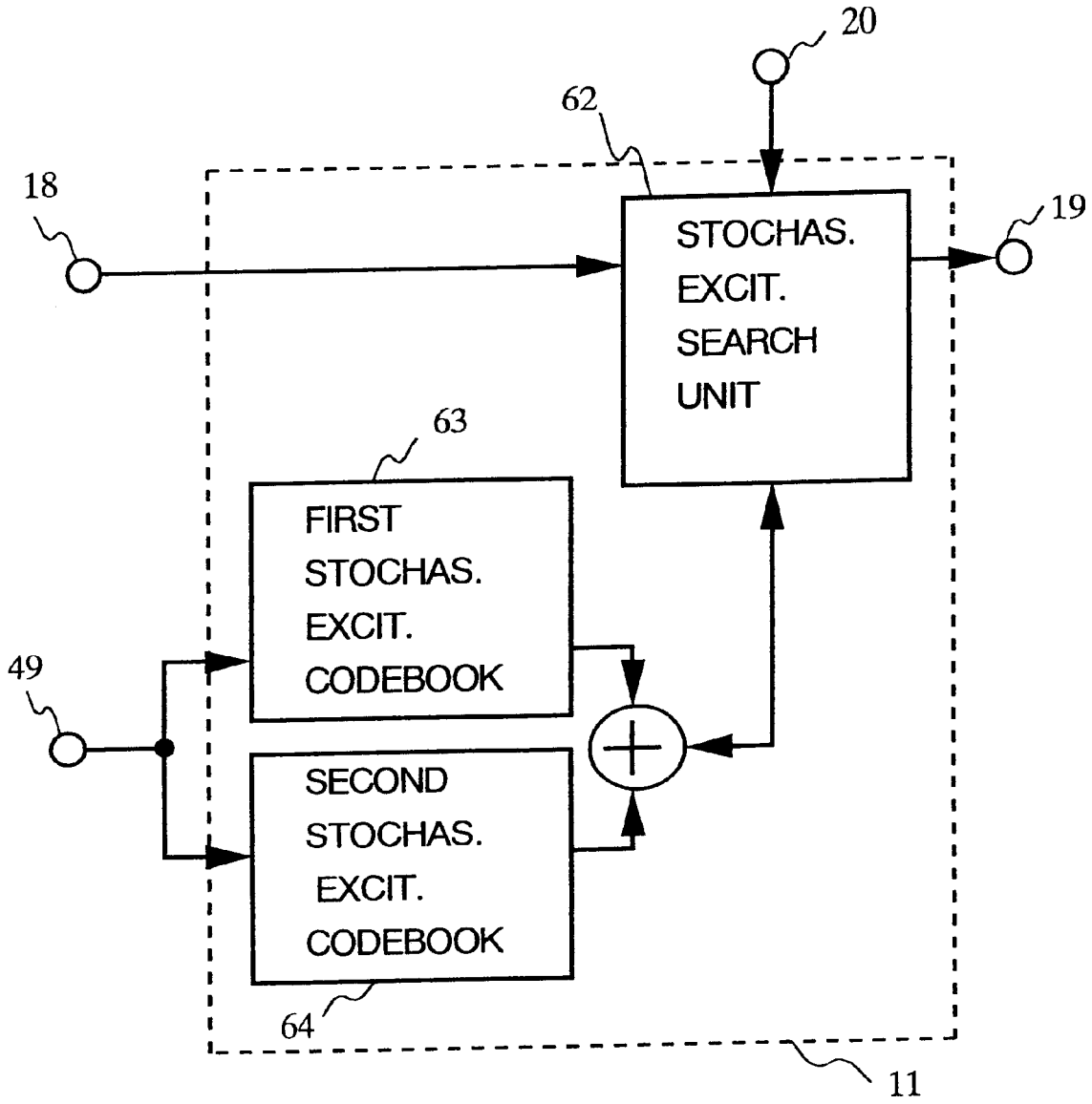
FIG. 10 is a block diagram showing a stochastic excitation coding unit in a speech coding/decoding apparatus according to Embodiment 6 of the present invention.

FIG. 10 shows the configuration of the stochastic excitation coding unit 11 of the speech coding/decoding apparatus according to Embodiment 6 of the present invention. The reference numbers in FIG. 10 are labeled correspondingly to those in FIG. 5. The whole configuration of the speech coding/decoding apparatus is similar to that in FIG. 9 or FIG. 13. In FIG. 10, a stochastic excitation search unit 62, a first stochastic excitation codebook 63, and a second stochastic excitation codebook 64 are shown.

The first stochastic excitation codebook 63 and the second stochastic excitation codebook 64 update each codeword based on the input pitch period 49. The stochastic excitation search unit 62 reads one time series vector in the first stochastic excitation codebook 63 and one time series vector in the second stochastic excitation codebook 64, based on each stochastic excitation code. A temporary stochastic excitation is generated by adding these two time series vectors. Then, an appropriate gain is multiplied with this temporary stochastic excitation and an adaptive excitation output from the adaptive excitation coding unit 10, and the multiplied values are added. The added signal is filtered by using the synthesis filter, in which coded linear predictive coefficient is applied, in order to generate a temporary synthetic signal. The distance between this temporary synthetic signal and the input speech 5 is calculated. One of the stochastic excitation codes which makes the distance shortest is selected. A temporary stochastic excitation corresponding to the selected stochastic excitation code is output as a stochastic excitation.

Figure 11:
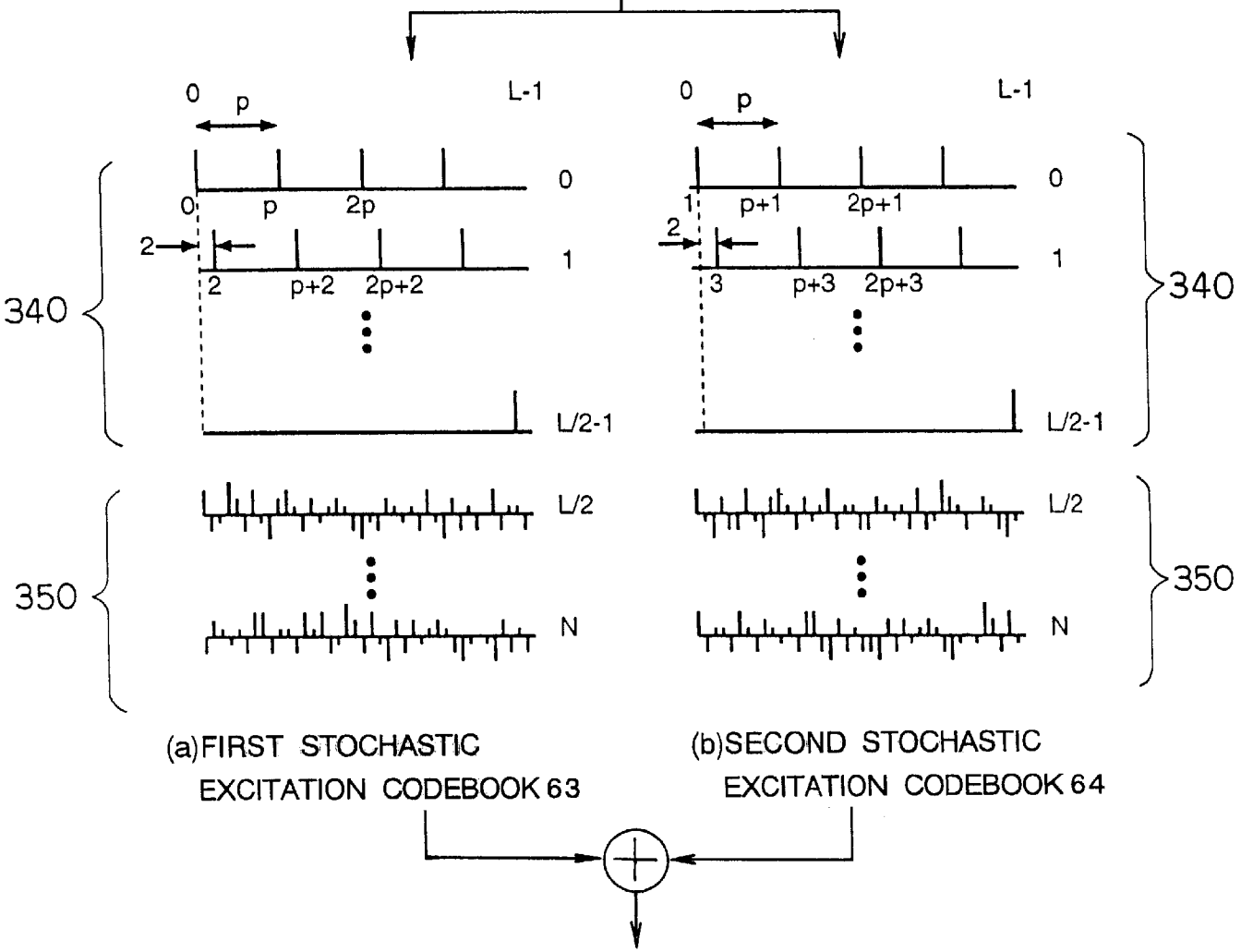
FIG. 11 illustrates lines for explaining configurations of the first stochastic excitation codebook and the second stochastic excitation codebook used in the stochastic excitation coding unit in the speech coding/decoding apparatus according to Embodiment 6 of the present invention.

FIG. 11 shows the configurations of the first stochastic excitation codebook 63 and the second stochastic excitation codebook 64. In FIG. 11, L indicates a frame length used for encoding an excitation signal, p indicates the pitch period 49, and N does the size of each stochastic excitation codebook. Codewords 340 for 0 through (L/2−1) indicate a series of pulses repeated with the pitch period p. Codewords 350 for (L/2) through N indicate excitation signal waveforms. The head positions of the pulse series in the first stochastic excitation codebook 63 shown in (a) of FIG. 11 are alternately different from those in the second stochastic excitation codebook 64 shown in (b) of FIG. 11. The head pulse positions are never the same positions. In FIG. 11, learned noise signals are stored in the codewords after the number of (L/2). It is also acceptable to apply unlearned noise, a signal other than the series of pulses repeated with the pitch period, and others, for the codeword after the number of (L/2). The codebooks, having the same configuration as the first stochastic excitation codebook 63 and the second stochastic excitation codebook 64, are provided in the stochastic excitation decoding unit 16 in the decoding unit 2. The stochastic excitation decoding unit 16 reads a codeword corresponding to the stochastic excitation code, adds the values of the codewords and outputs the added signal as a stochastic excitation.

As stated above, the speech coding/decoding apparatus according to Embodiment 6 includes the plural excitation signal codebooks, each of which is composed of plural codewords indicating excitation signal position information and plural codewords indicating excitation signal waveforms. Each excitation signal position information indicated by the codeword in each of the plural excitation signal codebooks is different from others one another. Then, the excitation signal is encoded or decoded by using these plural excitation signal codebooks. Therefore, it is possible to represent a periodic excitation signal which is not a series of pulses of pitch period or which is not a series of pulses having a period half of the pitch period. Consequently, the coding characteristic is improved without depending too much upon the input speech. In addition, since the excitation signal position information in each excitation signal codebook differs one another, the number of codewords for indicating the excitation signal position information is reduced. Therefore, the coding characteristic is improved in the case that the codebook size N is shorter than the frame length and the amount of the codewords indicating an excitation signal waveform is too small. In other words, it is even possible to define a part of a small-sized codebook as a codeword indicating excitation signal position information, in order to improve the coding characteristic.

A temporary stochastic excitation is generated by adding two time series vectors in this Embodiment 6. It is also acceptable to have a configuration where each of the two time series vectors, as an independent stochastic excitation signal, is respectively multiplied by a gain. In this case, though the amount of gain coding information is increased, the coding characteristic can be improved without having a great amount increase of information, because vector quantization is performed for all the gains at one time.

Embodiment 7

Figure 12:
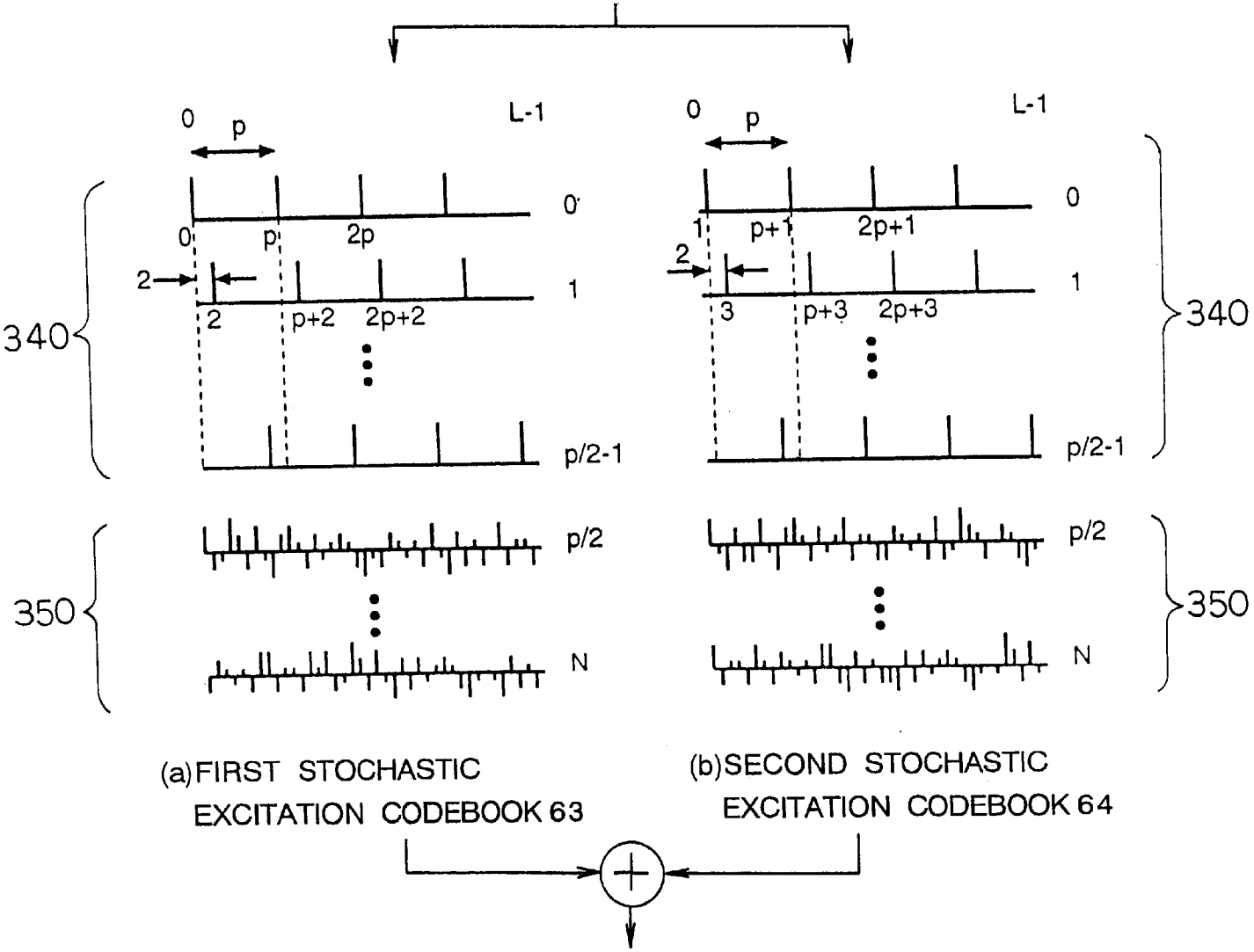
FIG. 12 illustrates lines for explaining configurations of the first stochastic excitation codebook and the second stochastic excitation codebook used in a stochastic excitation coding unit in a speech coding/decoding apparatus according to Embodiment 7 of the present invention.

FIG. 12 shows the first stochastic excitation codebook 63 and the second stochastic excitation codebook 64 used in the stochastic excitation coding unit 11 of the speech coding/decoding apparatus according to Embodiment 7. The whole configuration of the speech coding/decoding apparatus is the same as FIG. 9 or FIG. 13, and that of the stochastic excitation coding unit 11 is the same as FIG. 10.

The codewords for 0 through (p/2−1) indicate series of pulses repeated with the pitch period p. The different respect between FIG. 11 and FIG. 12 is that the number of the codewords composed of series of pulses in FIG. 12 is fewer than FIG. 11, because the head position of the pulse series is restricted within the pitch period length. When the pitch period p is longer than the frame length L, the configuration of FIG. 12 is the same as FIG. 11. The head pulse positions of the pulse series of the first stochastic excitation codebook 63 shown in (a) of FIG. 12 and the second stochastic excitation codebook 64 shown in (b) of FIG. 12 come alternately, consequently the head pulse positions never coincide. In FIG. 12, learned noise signals are stored in the codewords after the number of (p/2). It is also acceptable to apply unlearned noise, a signal other than a series of pulses repeated with pitch period, and others, for the codeword after the number of (p/2).

As stated above, the speech coding/decoding apparatus according to Embodiment 7 includes the plural excitation signal codebooks, each of which is composed of plural codewords indicating excitation signal position information and plural codewords indicating excitation signal waveforms. Each excitation signal position information indicated by the codeword in each of the plural excitation signal codebooks is different from others one another. Then, when the excitation signal is encoded by using these plural excitation signal codebooks, the number of codewords indicating excitation signal position information in the excitation signal codebook is controlled based on a pitch period. In addition to the effects of Embodiment 6, the number of codewords indicating the excitation signal position information is further reduced. Therefore, the speech coding/decoding apparatus has an effect that the coding characteristic is improved when the codebook size N is shorter than the frame length and the codewords indicating excitation signal waveforms are very few. In other words, it is even possible to define a part of a small-sized codebook as a codeword indicating excitation signal position information, in order to improve the coding characteristic.

When the excitation signal of a pitch period long is encoded by adapting time-wise lag (phase) of an algebraic excitation, based on peak position information for a pitch waveform of the adaptive excitation, as disclosed in the speech coding/decoding apparatus in article 4, the excitation signal encoding is realized by using a stochastic excitation codebook which partly has the following codeword. The codeword has pulses around the characteristic point of the peak position in the codebook. The pulses should be kept in the range of a pitch period length or in the range of a multiplied length of the pitch period by a constant equal to or less than 1.

INDUSTRIAL APPLICABILITY

According to the present invention, as stated above, a temporary gain for each of excitation signal position candidates is calculated and plural excitation signal positions are determined by using the temporary gain. Therefore, when an independent gain is finally added at each pulse, approximation accuracy of the gain in the excitation signal position searching is enhanced and it becomes easy to find the most appropriate excitation signal position. Consequently, the speech coding apparatus and the speech coding/decoding apparatus, wherein the encoding characteristic is improved, can be realized.

According to the present invention, an excitation signal is encoded into plural pulse excitation positions and excitation signal gains, by using an impulse response which is given the phase characteristic for excitation signal. Therefore, even if the number of the excitation signal position combinations increases, it is possible to perform coding/decoding for the excitation signal which is given the phase characteristic, as long as the calculation amount is practically kept. Accordingly, the speech coding apparatus and the speech coding/decoding apparatus, wherein the coding quality is improved because the quality in representing excitation signals is increased, can be realized.

According to the present invention, the number of excitation signal pulses is increased by restricting excitation signal position candidates to be within the pitch period when the pitch period is equal to or smaller than a specific value. Consequently, the speech coding apparatus, speech decoding apparatus and speech coding/decoding apparatus, wherein the coding quality is improved because the quality in representing excitation signals is increased, can be realized.

According to the present invention, a code indicating a pulse excitation position larger than the pitch period is reset to indicate a pulse excitation position within the pitch period. Since a code for unused pulse position is excluded, all the coding information becomes effective. Consequently, the speech coding apparatus, speech decoding apparatus and speech coding/decoding apparatus, wherein the coding quality is improved, can be realized.

According to the present invention, the excitation signal coding is performed by using both the first excitation signal coding unit, in which an excitation signal is encoded by plural pulse excitation positions and excitation signal gains, and the second excitation signal coding unit, which is different from the first unit. Then, one of the excitation signal coding units which leads the smaller encoding-distortion is selected. Consequently, the mode which leads the best coding characteristic is selected. The speech coding apparatus and speech coding/decoding apparatus, wherein the coding quality is improved, can be realized.

According to the present invention, plural excitation signal codebooks, each of which is composed of plural codewords indicating excitation signal position information and plural codewords indicating excitation signal waveforms, are included. Each excitation signal position information indicated by the codeword in each of the plural excitation signal codebooks is different from others one another. Then, the excitation signal is encoded or decoded by using these plural excitation signal codebooks. Therefore, it is possible to represent a periodic excitation signal which is not a series of pulses of pitch period or which is not a series of pulses having a period half of the pitch period. Consequently, the speech coding apparatus, speech decoding apparatus and speech coding/decoding apparatus, wherein the coding characteristic is improved without depending too much upon the input speech, can be realized.

In addition, since excitation signal position information in each excitation signal codebook differs one another, the number of codewords for indicating the excitation signal position information is reduced. Therefore, in the case that the codebook size N is shorter than the frame length and the amount of the codewords indicating an excitation signal waveform is too small, the coding characteristic is improved. In other words, it is even possible to define a part of a small-sized codebook as a codeword indicating excitation signal position information, in order to improve the coding characteristic. Accordingly, the speech coding apparatus, speech decoding apparatus and speech coding/decoding apparatus, wherein the coding characteristic is improved as the above, can be realized.

Furthermore, according to the present invention, the number of codewords indicating excitation signal position information in the excitation signal codebook is controlled based on a pitch period, and an excitation signal is encoded by using the excitation signal codebook. Namely, the number of codewords indicating the excitation signal position information is further reduced.

The above stated inventions can be utilized as a method for speech coding/decoding.

What is claimed is:

1. A speech coding apparatus which separates input speech into spectrum-envelope information and an excitation signal, and encodes the excitation signal at each frame, the speech coding apparatus comprising:

an impulse response calculating unit for calculating an impulse response of a synthesis filter, based on the spectrum-envelope information;

a phase adding filter for receiving the impulse response calculated by said impulse response calculating unit and giving a specific excitation signal phase characteristic to the calculated impulse response, thereby generating a phase-added impulse response; and an excitation signal coding unit for receiving the phase-added impulse response and encoding the excitation signal into a plurality of pulse excitation positions and a plurality of excitation signal gains by using the phase-added impulse response.

2. A speech coding/decoding apparatus which has a coding unit for separating input speech into spectrum-envelope information and an excitation signal, and encoding the excitation signal at each frame, and a decoding unit for generating an output speech by decoding an encoded excitation signal, the coding unit of the speech coding/decoding apparatus comprising:

an impulse response calculating unit for calculating an impulse response of a synthesis filter, based on the spectrum-envelope information;

a phase adding filter for receiving the impulse response calculated by said impulse response calculating unit and giving a specific excitation signal phase characteristic to the calculated impulse response, thereby generating a phase-added impulse response; and an excitation signal coding unit for receiving the phase-added impulse response and encoding the excitation signal into a plurality of pulse excitation positions and a plurality of excitation signal gains based on the phase-added impulse response, the decoding unit of the speech coding/decoding apparatus comprising:

an excitation signal decoding unit for generating an excitation signal by decoding a plurality of pulse excitation positions and a plurality of excitation signal gains.

3. A speech coding method for separating input speech into spectrum-envelope information and an excitation signal, and encoding the excitation signal at each frame, the speech coding method comprising steps of:

calculating an impulse response of a synthesis filter based on the spectrum-envelope information;

adding a specific excitation signal phase characteristic to the calculated impulse response, thereby generating a phase-added impulse response; and receiving the phase-added impulse response and encoding the excitation signal into a plurality of pulse excitation positions and a plurality of excitation signal gains using the phase-added impulse response.

* * * * *